US006270193B1

(12) United States Patent
Hiwada

(10) Patent No.: US 6,270,193 B1
(45) Date of Patent: Aug. 7, 2001

(54) INK-JET AND INK JET RECORDING APPARATUS HAVING IC CHIP ATTACHED TO HEAD BODY BY RESIN MATERIAL

(75) Inventor: Shuhei Hiwada, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 08/867,906

(22) Filed: Jun. 3, 1997

(30) Foreign Application Priority Data

Jun. 5, 1996 (JP) ..... 8-165301
Jun. 5, 1996 (JP) ..... 8-165302

(51) Int. Cl.[7] ..... B41J 2/14
(52) U.S. Cl. ..... 347/50; 347/68
(58) Field of Search ..... 347/9, 10, 11, 347/70, 71, 68, 50

(56) References Cited

U.S. PATENT DOCUMENTS

| | | | | |
|---|---|---|---|---|
| 4,719,502 | * | 1/1988 | Ikaya et al. | 357/72 |
| 4,797,542 | * | 1/1989 | Hara | 235/380 |
| 5,128,694 | | 7/1992 | Kanayama . | |
| 5,146,236 | | 9/1992 | Hirata et al. . | |
| 5,182,582 | | 1/1993 | Okamura . | |
| 5,198,554 | * | 3/1993 | Inagaki et al. | 549/237 |
| 5,402,159 | * | 3/1995 | Takahashi et al. | 347/9 |
| 5,534,903 | * | 7/1996 | Hayakawa et al. | 347/71 |
| 5,583,779 | * | 12/1996 | Naclerio et al. | 364/464.02 |
| 5,594,475 | * | 1/1997 | Komakine et al. | 347/9 |
| 5,764,267 | * | 6/1998 | Akutsu et al. | 347/199 |
| 5,821,953 | * | 10/1998 | Nakano et al. | 347/10 |
| 5,844,587 | * | 12/1998 | Ando et al. | 347/69 |
| 5,889,539 | * | 3/1999 | Kamoi et al. | 347/50 |
| 5,984,447 | * | 11/1999 | Ohashi | 347/71 |
| 6,027,208 | * | 2/2000 | Amano | 347/70 |

FOREIGN PATENT DOCUMENTS 7-304168 11/1995 (JP) .

OTHER PUBLICATIONS

Patent Abstract of Japan, vol. 16, No. 254, JP 4–53296A, Feb. 1992.*
Patent Abstracts of Japan, vol. 1, No. 359, JP 61–158167A, Jul. 1986.*

* cited by examiner

*Primary Examiner*—Benjamin R. Fuller
*Assistant Examiner*—C. Dickens
(74) *Attorney, Agent, or Firm*—Oliff & Berridge, PLC

(57) ABSTRACT

An ink-jet recording apparatus has an ink-jet head which includes a main head body including ink chambers formed therein, piezoelectric elements for changing a volume of each of the ink chambers in accordance with application of a driving voltage, and an IC chip including a driving circuit for driving the piezoelectric elements. An anisotropic conductive material having adhesive force is applied to a surface of the IC chip formed with chip electrodes, the material is covered with a surface of the main head body formed with head electrodes, and a pressure is applied in an overlapping direction so that electric continuity is established between the both electrodes. The heat generated in the IC chip can be efficiently radiated through the anisotropic conductive material. The IC chip can be prevented from damage which would be otherwise caused by the heat. In place of the anisotropic conductive material, a potting material can be used in combination with a conductive adhesive or solder.

40 Claims, 18 Drawing Sheets

INK-JET AND INK JET RECORDING APPARATUS HAVING IC CHIP ATTACHED TO HEAD BODY BY RESIN MATERIAL

FIELD OF THE INVENTION

The present invention relates to an ink-jet recording apparatus for performing printing on an objective print medium by utilizing displacement of piezoelectric elements to discharge ink droplets from nozzles.

DESCRIPTION OF THE RELATED ART

An ink-jet head, which is included in a conventional ink-jet recording apparatus, is shown in FIG. 18. As shown in FIG. 18, a plurality of electrodes (hereinafter abbreviated as "head electrode") 82, which are connected to a plurality of piezoelectric elements for constructing the ink-jet head 80, are formed on both side surfaces of the ink-jet head 80. Flexible printed circuit boards (hereinafter abbreviated-as "FPC") 84 are electrically connected to the respective electrodes 82. A driver IC chip-on-board (hereinafter referred to as "COB") 88, on which a driver IC chip 86 is carried, is electrically connected to FPC 84. The driver IC chip 86 is electrically connected to an unillustrated control circuit through electrodes 90. Namely, when the ink-jet head 80 is installed to the ink-jet recording apparatus, the electrodes 90 are connected to electrodes for mating with the electrodes 90 respectively, and thus the driver IC chip 86 electrically communicates with the control circuit.

The driver IC chip 86 outputs driving signals to the respective piezoelectric elements in accordance with the timing of input of a control signal outputted from the control circuit. Ink contained in an ink chamber is pressurized in response to displacement of the piezoelectric elements, and ink droplets are discharged from nozzles 81. Thus, printing is performed on an objective print medium.

The printing is performed by simultaneously driving the many piezoelectric elements at a short interval to discharge ink droplets from the nozzles 81. During this process, electric power loss occurs in the driver IC chip 86. For this reason, the driver IC chip 86 reaches a high temperature in a short period of time.

However, in the case of the conventional ink-jet head 80 described above, the driver IC chip 86 is carried on COB 88. The heat of the driver IC chip 86 is radiated in accordance with natural cooling based on contact with the outside air. Accordingly, it is impossible to obtain a sufficient heat radiation effect. Therefore, a problem arises in that the driver IC chip 86 may be possibly damaged due to overheat.

Especially, in the case of recent ink-jet recording apparatuses, printing is performed at an increasingly high resolution, the number of simultaneously driven nozzles is increased, and the driving interval is shortened. For these reasons, a much larger driving voltage is concentrated on the driver IC chip, and the driver IC chip inevitably has a high temperature. Therefore, it is an object to improve the heat radiation efficiency of the driver IC chip.

SUMMARY OF THE INVENTION

An object of the present invention is to provide an ink-jet head which makes it possible to improve the heat radiation efficiency of an IC chip used for operating a driving circuit for piezoelectric elements accommodated in the ink-jet head, and an ink-jet recording apparatus including the ink-jet head.

Another object of the present invention is to provide a method for installing an IC chip to an ink-jet head without damaging the IC chip by heat when the IC chip containing a circuit for driving piezoelectric elements is installed to the ink-jet head for discharging an ink by driving the piezoelectric elements.

According to a first aspect of the present invention, there is provided an ink-jet head comprising:

a main head body including ink chambers formed therein;

piezoelectric elements for changing a volume of each of the ink chambers in accordance with application of a driving voltage; and an IC chip including a driving circuit for driving the piezoelectric elements;

the IC chip being attached to an outer wall surface of the main head body via a resin material intervened therebetween.

According to a second aspect of the present invention, there is provided an ink-jet recording apparatus comprising:

an ink-jet head including:

a main head body including ink chambers formed therein;

piezoelectric elements for changing a volume of each of the ink chambers in accordance with application of a driving voltage; and an IC chip including a driving circuit for driving the piezoelectric elements, the IC chip being attached to an outer wall surface of the main head body via a resin material intervened therebetween; and a carriage for carrying the ink-jet head and an ink cartridge, the carriage being relatively movable with respect to an objective print medium.

According to the ink-jet head concerning the first aspect and the ink-jet recording apparatus concerning the second aspect, the IC chip is attached to the outer wall surface of the main head body via the resin material intervened therebetween. Accordingly, the heat, which is generated in the IC chip, can be transferred to the ink-jet head (main head body) through the resin material such as a potting material. The ink-jet head includes portions containing the ink, such as the ink chambers and an ink manifold. Therefore, the heat transferred to the ink-jet head is transferred to the ink contained in the foregoing portions, and the ink is jetted from the nozzles. As a result, the heat generated in the IC chip is radiated to the outside of the ink-jet head. Therefore, it is possible to provide the ink-jet head and the ink-jet recording apparatus which are excellent in heat radiation efficiency as compared with the conventional ink-jet head based on natural heat radiation for the IC chip.

The ink-jet head of the present invention and the inkjet recording apparatus including the ink-jet head may be arranged as follows. Namely, head electrodes connected to the piezoelectric elements are formed on one outer wall surface of the main head body, and chip electrodes electrically connected to the driving circuit are formed on one surface of the IC chip. The IC chip is attached to the outer wall surface of the main head body so that the one outer wall surface of the main head body is opposed to the one surface of the IC chip, and the head electrodes are electrically connected to the chip electrodes. The resin is charged between the one outer wall surface of the main head body and the one surface of the IC chip. According to the foregoing arrangement of the ink-jet head, the heat generated in the IC chip can be efficiently radiated through the resin charged between the opposing surfaces of the main head body and the IC chip. Further, the heat generated in the IC chip can be radiated through the chip electrodes and the head electrodes.

The head electrodes and the chip electrodes may be electrically connected to one another by the aid of a conductive adhesive or solder. By electrically connecting them with the conductive adhesive or solder, the IC chip can be fixedly secured to the outer wall surface of the main head body by the conductive adhesive or the solder. Moreover, the heat generated from the IC chip can be radiated through the conductive adhesive or the solder.

In the ink-jet head and the ink-jet recording apparatus according to the present invention, the IC chip may be attached to a cover plate or a piezoelectric ceramic plate for constructing the main head body via the resin material intervened therebetween. The resin may be an epoxy resin.

It is preferable that the IC chip is attached to the outer wall surface of. the main head body via the resin material intervened therebetween, and the IC chip is covered with the resin material. Because the same material is used for the resin material charged between the main head body and the IC chip and for the resin material for covering the IC chip, it is possible to simultaneously perform the step of charging the resin material between the main head body and the IC chip, and the step of covering the IC chip. Thus, it is possible to improve the efficiency of production.

According to a third aspect of the present invention, there is provided an ink-jet head comprising:

a main head body including ink chambers formed therein;

piezoelectric elements for changing a volume of each of the ink chambers in accordance with application of a driving voltage; and an IC chip including a driving circuit for driving the piezoelectric elements;

the IC chip being attached to an outer wall surface of the main head body via an anisotropic conductive material intervened therebetween whereby the driving circuit is electrically connected to the piezoelectric elements.

According to a fourth aspect of the present invention, there is provided an ink-jet recording apparatus comprising:

an ink-jet head including:

a main head body including ink chambers formed therein;

piezoelectric elements for changing a volume of each of the ink chambers in accordance with application of a driving voltage; and an IC chip including a driving circuit for driving the piezoelectric elements, the IC chip being attached to an outer wall surface of the main head body via an anisotropic conductive material intervened therebetween whereby the driving circuit is electrically connected to the piezoelectric elements; and a carriage for carrying the ink-jet head and an ink cartridge, the carriage being relatively movable with respect to an objective print medium.

According to the ink-jet head concerning the third aspect and the ink-jet recording apparatus concerning the fourth aspect, the IC chip is attached to the outer wall surface of the main head body via the anisotropic conductive material intervening therebetween. Accordingly, the heat, which is generated in the IC chip, can be transferred to the ink-jet head (main head body) through the anisotropic conductive material. The ink-jet head includes portions containing the ink, such as the ink chambers and an ink manifold. Therefore, the heat transferred to the ink-jet head is transferred to the ink contained in the foregoing portions, and the ink is jetted from the nozzles. As a result, the heat generated in the IC chip is radiated to the outside of the ink-jet head. Therefore, it is possible to provide the ink-jet head and the ink-jet recording apparatus which are excellent in heat radiation efficiency as compared with the conventional ink-jet head based on natural heat radiation for the IC chip.

The "anisotropic conductive material" is a material in which the electric conductivity differs depending on directions in the material. This term refers to a material in which when a force is applied in one direction, the electric conductivity in the one direction is greatly different from electric conductivity in the other directions. The anisotropic conductive material exhibits definite conductive behavior in a specified direction. Therefore, only when the anisotropic conductive material is allowed to intervene between the IC chip and the outer wall surface of the main head body, and a pressure is applied in a direction of thickness of the anisotropic conductive material, then the driving circuit and the piezoelectric elements can be electrically connected to one another extremely easily.

It is preferable that the anisotropic conductive material has an adhesive property. For example, the anisotropic conductive material may be a material obtained by dispersing a conductive substance in an epoxy resin adhesive. Accordingly, one outer wall surface of the main head body can be glued to one surface of the IC chip by the aid of the anisotropic conductive material, making it unnecessary to use any other adhesive.

The ink-jet head concerning the third aspect and the ink-jet recording apparatus concerning the fourth aspect may be arranged as follows. Namely, head electrodes connected to the piezoelectric elements are formed on one outer wall surface of the main head body, and chip electrodes electrically connected to the driving circuit are formed on one surface of the IC chip. The one outer wall surface of the main head body is opposed to the one surface of the IC chip, and the anisotropic conductive material is charged between the one outer wall surface of the main head body and the one surface of the IC chip so that the driving circuit is electrically connected to the piezoelectric elements. According to the foregoing arrangement of the ink-jet head, the heat can be efficiently radiated through the anisotropic conductive material charged between the opposing surfaces of the main head body and the IC chip. Further, the heat generated from the IC chip can be radiated through the chip electrodes and the head electrodes.

In the ink-jet head and the ink-jet recording apparatus according to the present invention, the ink chambers may be comparted by walls composed of the piezoelectric elements, and the walls composed of the piezoelectric elements may be perpendicular to the one outer wall surface of the main head body. When the IC chip is installed to the ink-jet head, a pressing force is applied against the IC chip onto the attachment surface of the ink-jet head. However, since the attachment surface is perpendicular to surfaces of the walls of the piezoelectric elements, the attachment surface has a high strength to withstand the pressing force against the attachment surface. Thus, the ink chambers can be prevented from occurrence of distortion.

According to a fifth aspect of the present invention, there is provided a method for installing an IC chip including a circuit for driving piezoelectric elements to an ink-jet head for discharging an ink by driving the piezoelectric elements, comprising the steps of:

placing an anisotropic conductive material having an adhesive property on one of an outer wall surface of the ink-jet head including head electrodes formed thereon and a surface of the IC chip including chip electrodes formed thereon;

covering the anisotropic conductive material with the other of the outer wall surface of the ink-jet head including the head electrodes formed thereon and the surface of the IC chip including the chip electrodes formed thereon; and pressing the anisotropic conductive material interposed between the ink-jet head and the IC chip, from at least one of the ink-jet head and the IC chip.

According to the method for installing the IC chip to the ink-jet head of the present invention, the anisotropic conductive material having the adhesive property is charged between the ink-jet head and the IC chip to join the both to one another. Accordingly, it is unnecessary to provide any conductive material such as solder for making continuity with limitation to the chip electrode portions and the head electrode portions.

The anisotropic conductive material is merely charged over a broad region defined between the ink-jet head and the IC chip. After that, continuity can be obtained between the chip electrodes and the head electrodes positioned at specific positions within the broad region respectively merely by applying a pressure in a direction to allow the ink-jet head to approach the IC chip. Therefore, the IC chip can be installed to the ink-jet head extremely easily. Moreover, since the anisotropic conductive material has the adhesive property, it is unnecessary to use any additional adhesive for gluing the IC chip to the ink-jet head, and it is possible to reduce the production cost.

DETAILED DESCRIPTION OF THE PREFERRED EMBODIMENTS

An ink-jet recording apparatus according to a first embodiment of the present invention will be explained below with reference to the drawings.

Figure 1:
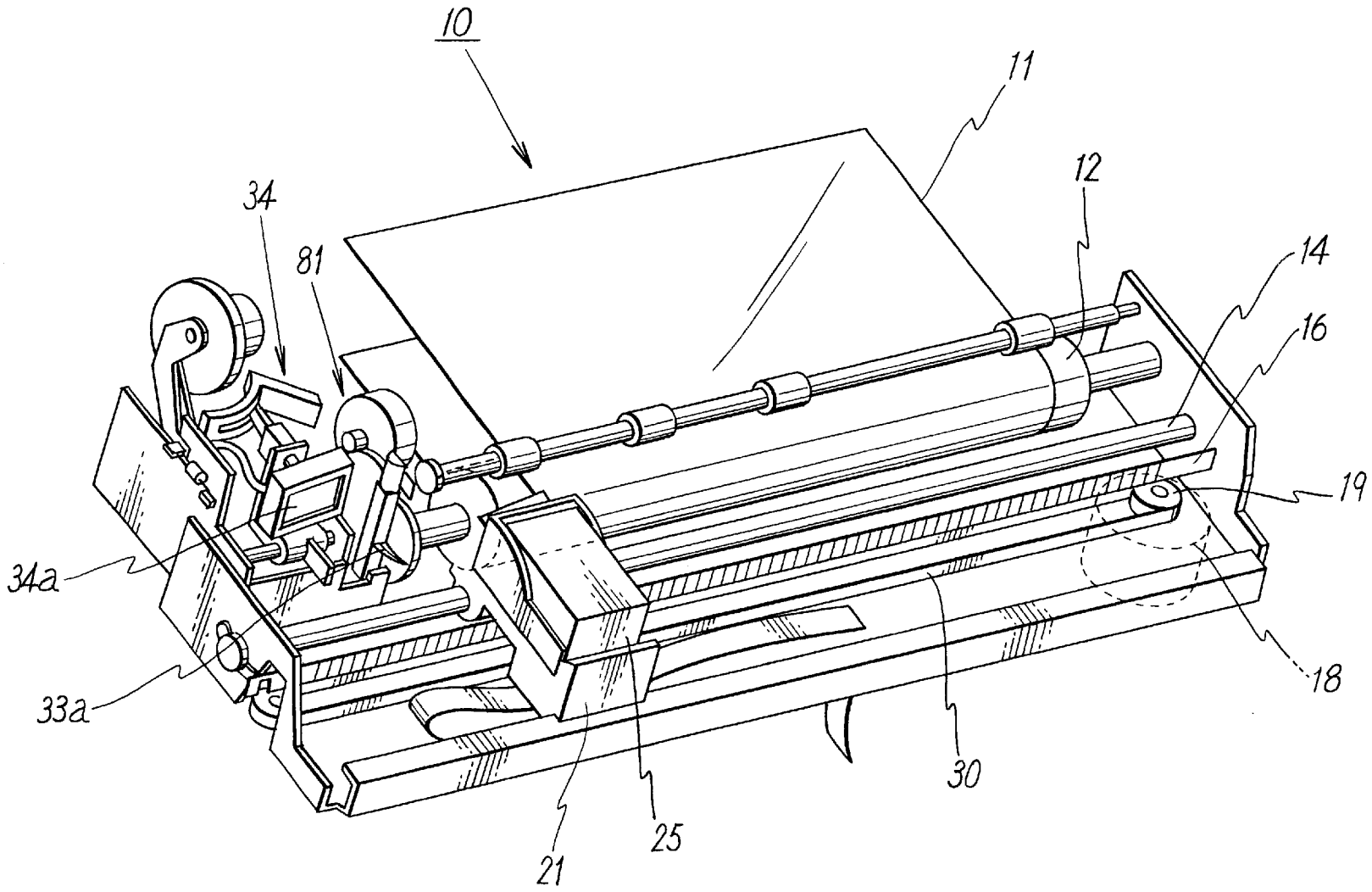
FIG. 1 illustratively shows a principal structure of an ink-jet recording apparatus according to a first embodiment of the present invention.
Figure 2:
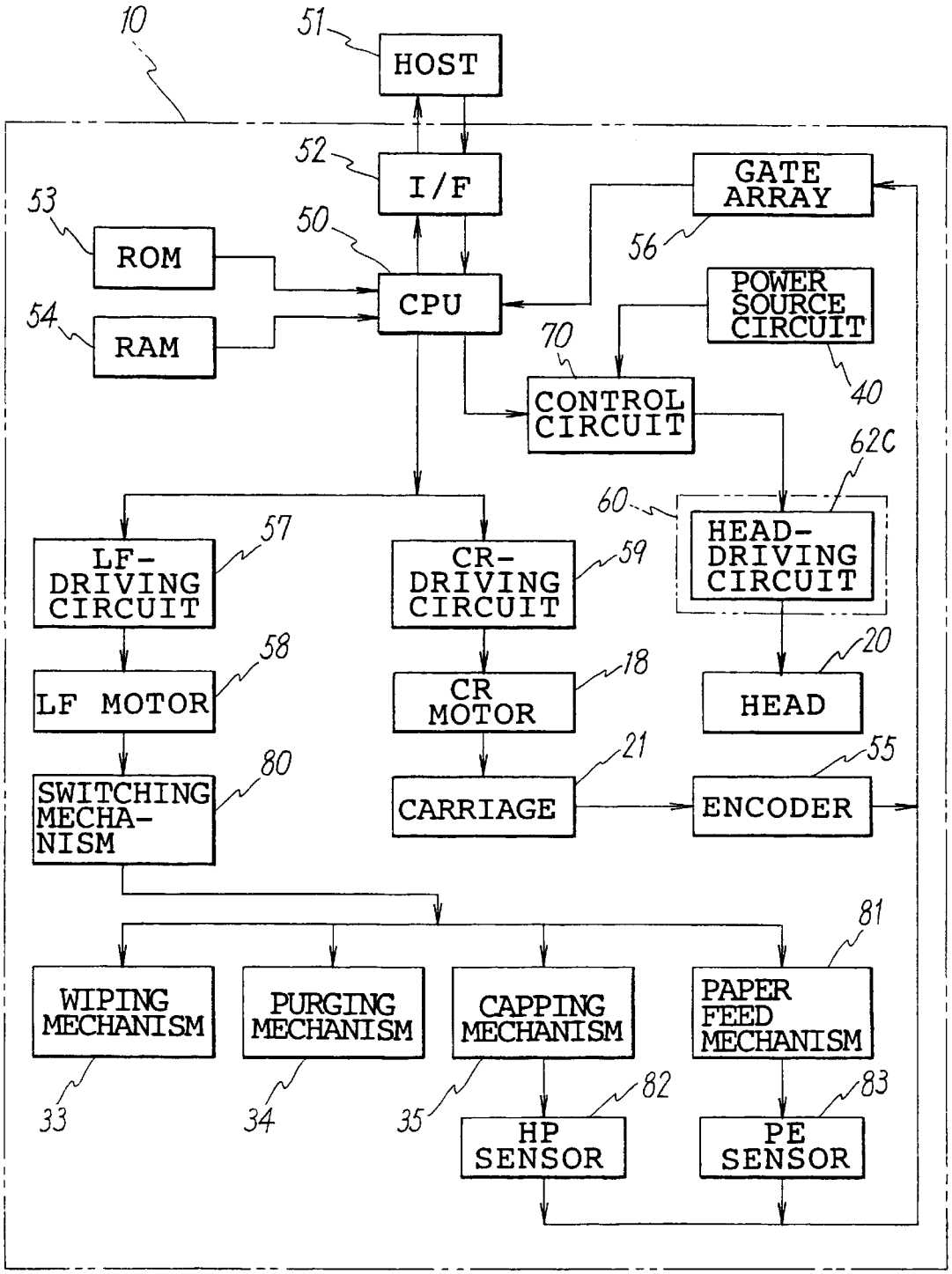
FIG. 2 shows a block diagram illustrating a control system of the ink-jet recording apparatus shown in FIG. 1.

FIG. 1 illustratively shows a principal structure of the ink-jet recording apparatus according to the first embodiment of the present invention. FIG. 2 shows a block diagram illustrating a control system of the ink-jet recording apparatus.

In the following embodiment described below, explanation will be made for a color ink-jet printer (hereinafter abbreviated as "printer") for performing color printing, representative of ink-jet recording apparatuses.

As shown in FIG. 1, the printer 10 is provided with a platen 12 for charging a sheet of printing paper 11 as an objective print medium. The platen 12 is rotated by a paper feed mechanism 81 connected to an LF motor (leaf feed motor or paper feed motor) 58 (see FIG. 2). An ink-jet head (main head body) 20 is provided at a position opposing to the platen 12. The ink-jet head 20 is provided with an ink cartridge 25 for supplying an ink to the ink-jet head 20. The ink-jet head 20 and the ink cartridge 25 are carried on a carriage 21. A guide shaft 14, which is installed in a widthwise direction of the printer 10, is slidably inserted through a front lower portion of the carriage 21.

The carriage 21 is connected to an endless belt 30 wound around a pulley 19 of a CR motor (carriage return motor or motor for moving the carriage) 18.

Thus, the ink-jet head 20 makes reciprocate movement on the guide shaft 14 in accordance with rotation of the CR motor 18 while opposing to the platen 12. A step motor is used for the LF motor 58. A DC motor, in which the velocity of rotation is controlled by PWM control, is used for the CR motor 18. The ink-jet head 20, the LF motor 58, and the CR motor 18 are driven by electric power supplied from a power source 40 (see FIG. 2).

A linear type timing slit 16 are provided along and under the guide shaft 14. The carriage 21 is provided, at a lower portion of its front surface, with a sensor element (not shown) for reading the spacing distance between slits printed on the timing slit 16 and outputting a pulse signal corresponding to a position of the carriage 21. An encoder 55 (see FIG. 2) is constructed by the timing slit 16 and the sensor element.

The printer 10 includes a flushing function for periodically discharging any defective ink containing bubbles to an ink absorber (not shown) to maintain a good printing state. The printer 10 is provided with a purging mechanism 34 for periodically sucking any dried ink and foreign matters clogged in the nozzles to maintain a good ink-discharging state. A suction cap 34*a* for covering the heat subjected to purging is provided on a left side in the direction of movement of the ink-jet head 20.

The printer 10 is provided with a capping mechanism 35 (see FIG. 2) for covering nozzle-forming surfaces of the respective heads 21 to 24 with the suction cap 34*a* when the ink-jet head 20 is not used for a certain period of time or longer. The printer 10 is provided with a wiping mechanism 33 (see FIG. 2) for wiping and cleaning any ink deposited on the nozzle-forming surfaces of the ink-jet head 20. A wiper member 33*a* is provided on a right side of the suction cap 34*a* (see FIG. 1).

Next, explanation will be made for main components of a control system for the foregoing printer 10 with reference to FIG. 2.

The printer 10 is provided with CPU 50 for performing various operation processes described later on. Those connected to CPU 50 include an interface 52 for receiving signals such as printing data outputted from a host computer 51, and a control circuit 70 for controlling a head-driving circuit 62*c*. Those connected to CPU 50 also include RAM 54 and ROM 53 which stores printing programs for performing printing by driving the ink-jet head 20, and a gate array 56 for inputting, for example, an encoder signal outputted from the encoder 55 to compute the position of the carriage 21.

CPU 50 stores, in a predetermined region in RAM 54, printing data received from the host computer 51 through the interface 52. CPU 50 outputs various control signals for driving the LF motor 58, the CR motor 18, and the inkjet head 20 in accordance with printing programs previously stored in ROM 53 described above.

Among the control signals, an LF motor-driving control signal for driving the LF motor 58 is inputted into an LF-driving circuit 57. The LF motor 58 is driven in accordance with an LF motor-driving signal outputted from the LF-driving circuit 57. Namely, the printing paper 11 is fed in the vertical direction in accordance with the driving of the LF motor 58.

The wiping mechanism 33, the purging mechanism 34, and the capping mechanism 35 are driven by the LF motor 58 through a switching mechanism 80 respectively. Among the control signals, a CR motor-driving control signal for driving the CR motor 18 is inputted into a CR-driving circuit 59. The CR motor 18 is driven in accordance with a CR motor-driving signal outputted from the CR-driving circuit 59. The carriage 21 is reciprocated in accordance with the driving of the CR motor 18. The position of the carriage 21 is detected by the encoder 55.

The encoder signal, which is outputted from the encoder 55, is inputted into the gate array 56. The gate array 56 generates, for example, a velocity data signal for the carriage 21, a positional control pulse for the carriage 21 (reference pulse), and a printing timing pulse for driving the ink-jet head 20, on the basis of the inputted encoder signal.

The velocity date (time interval value between respective edges of the encoder signal), which is outputted from the gate array 56, is inputted into CPU to compute a PWM signal (pulse width of the driving signal for the CR motor 18) which is necessary to control the velocity of the carriage 21. The positional control pulse (reference pulse) is also inputted into CPU 50 to compute the present position of the carriage 21. CPU 50 also performs control operations including, for example, writing of delay count values used to obtain a coincident printing position when the printing direction is inverted, and writing of data to permit the printing start signal, into a register in the gate array 56.

Further, CPU 50 counts, for example, pulse signals as the driving signal for the LF motor 58 to count the amount of printing paper feed executed by the LF motor 58 and the paper feed mechanism 81, and count the amount of rotation of a cam for driving the purging mechanism 34 or the capping mechanism 35. The capping mechanism 35 is provided with an HP (home position) sensor 82 for detecting the return of the carriage 21 to a capping home position (home position). The paper feed mechanism 81 is provided with a PE (paper empty) sensor 83 for detecting insertion or discharge of the printing paper 11.

Next, an arrangement of the ink-jet head 20 will be explained with reference to FIG. 3.

Figure 3:
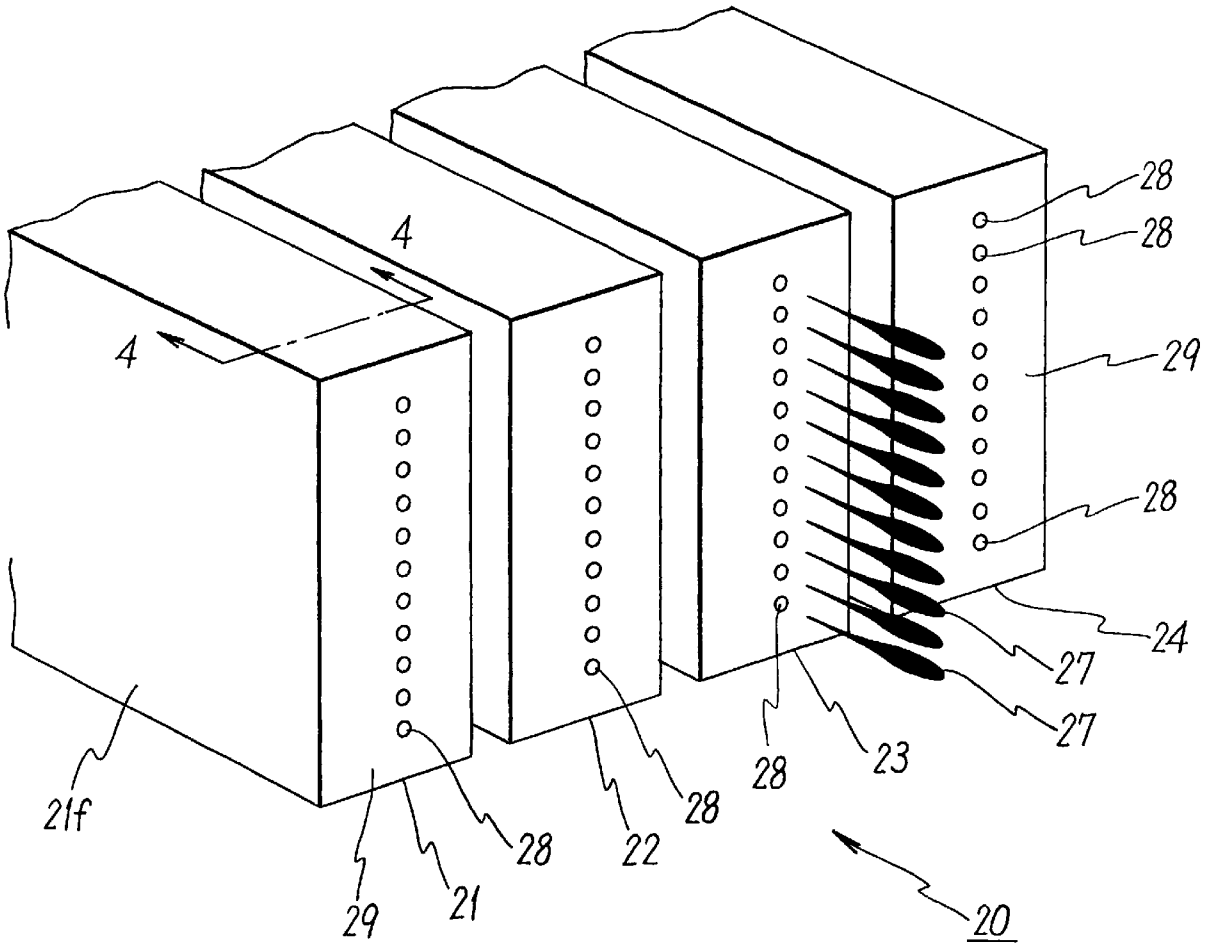
FIG. 3 illustratively shows an exploded perspective view of an ink-jet head 20 as viewed from a side of nozzle plates 29 formed with nozzles 28 for discharging ink droplets.

FIG. 3 illustratively shows an exploded perspective view of the ink-jet head 20 as viewed from a side of nozzle plates 29 formed with nozzles 28 for discharging ink droplets. As shown in FIG. 3, the ink-jet head 20 comprises a head for black 21 for discharging a black ink, a head for yellow 22 for discharging a yellow ink, a head for cyan 23 for discharging a cyan ink, and a head for magenta 24 for discharging a magenta ink. The ink cartridge 25 (see FIG. 1) provided for the ink-jet head 20 is arranged and divided into ink cartridges exclusively used for the respective colors (not shown). The ink-jet head 20 has a structure which is removable from the ink cartridge 25.

In FIG. 3, the heads for the respective colors are depicted as if they are separated from each other by a spacing distance therebetween for convenience of explanation. However, in fact, the heads for the respective colors are formed in an integrated manner.

Next, an internal structure of the ink-jet head 20 will be explained with reference to FIG. 4.

The heads 21 to 24 for the respective colors have the same internal structure. Accordingly, explanation will be made herein for the representative internal structure of the head for black (hereinafter abbreviated as "head") 21. FIG. 4 shows a part of a vertical cross section of the internal structure of the head 21 taken along a direction A–A', as viewed in front of the discharge surface 29.

Figure 4:
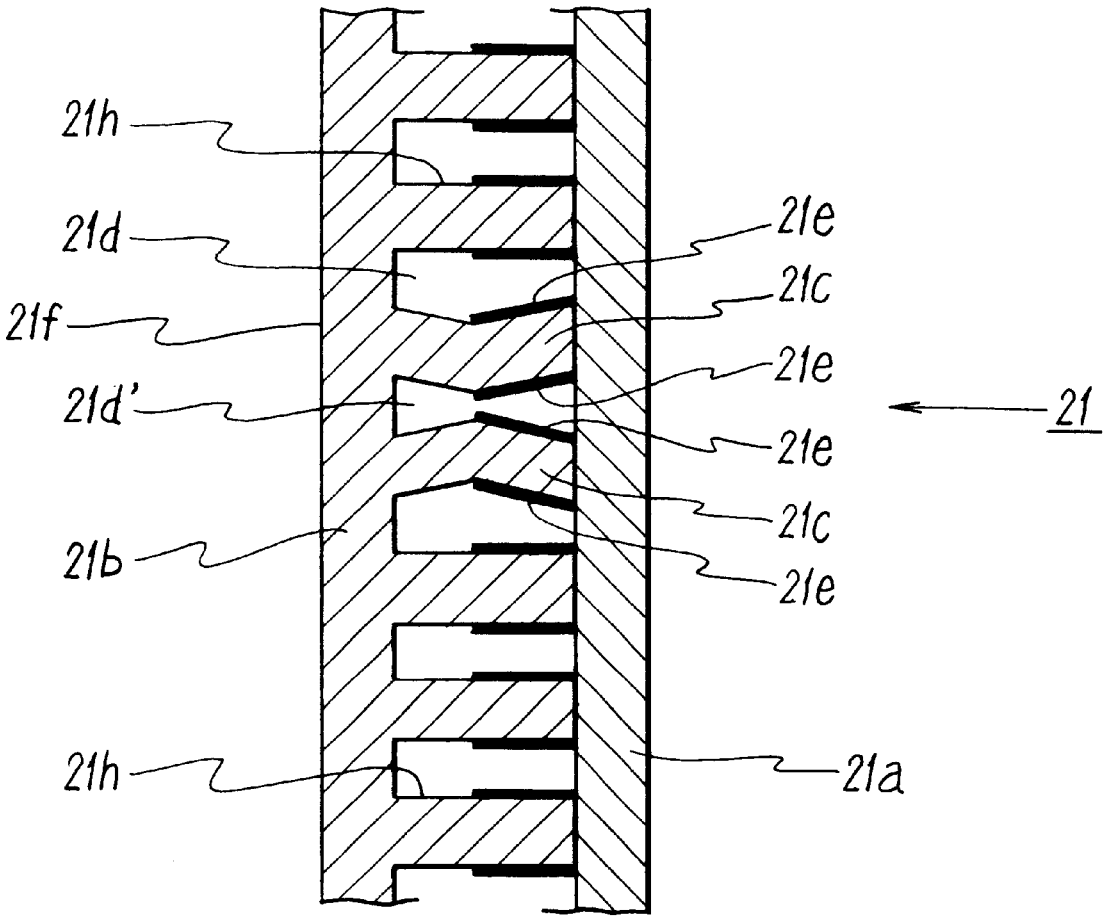
FIG. 4 illustratively shows a partial vertical cross-sectional view illustrating a part of a cross section of an internal structure of a head 21 as viewed from the front of the discharge surface 29.

As shown in FIG. 4, the head 21 is provided with a flat plate-shaped cover plate 21*a*. A flat plate-shaped piezoelectric ceramic plate 21*b* is provided opposite to the cover plate 21*a*.

A plurality of piezoelectric elements 21*c*, which are perpendicular to both plates 21*a*, 21*b* and separated by an equal spacing distance, are formed between both plates 21*a*, 21*b*. Thus, a plurality of ink chambers 21*d* are formed. Film-shaped electrodes 21*e*, 21*e* are formed on upper and lower surfaces of each of the piezoelectric elements 21*c*.

When a driving voltage, which is outputted from a driver IC chip 60 (see FIG. 5), is applied between both electrodes 21*e*, 21*e*, the piezoelectric element 21*c* is quickly deformed (displaced) toward the inside of the ink chamber 21*d*' in accordance with the piezoelectric thickness slide effect. The deformation decreases the volume of the ink chamber 21*d*', and the ink pressure is quickly increased. Thus, a pressure wave is generated, and ink droplets 27 are discharged from the nozzle (see FIG. 3) communicating with the ink chamber 21*d*' toward the printing paper 11 to perform printing.

Next, explanation will be made with reference to FIGS. 5 to 8 for an attachment structure of the ink-jet head 20 and the driver IC chip (hereinafter referred to as "IC chip") for driving the ink-jet head 20.

Figure 5:
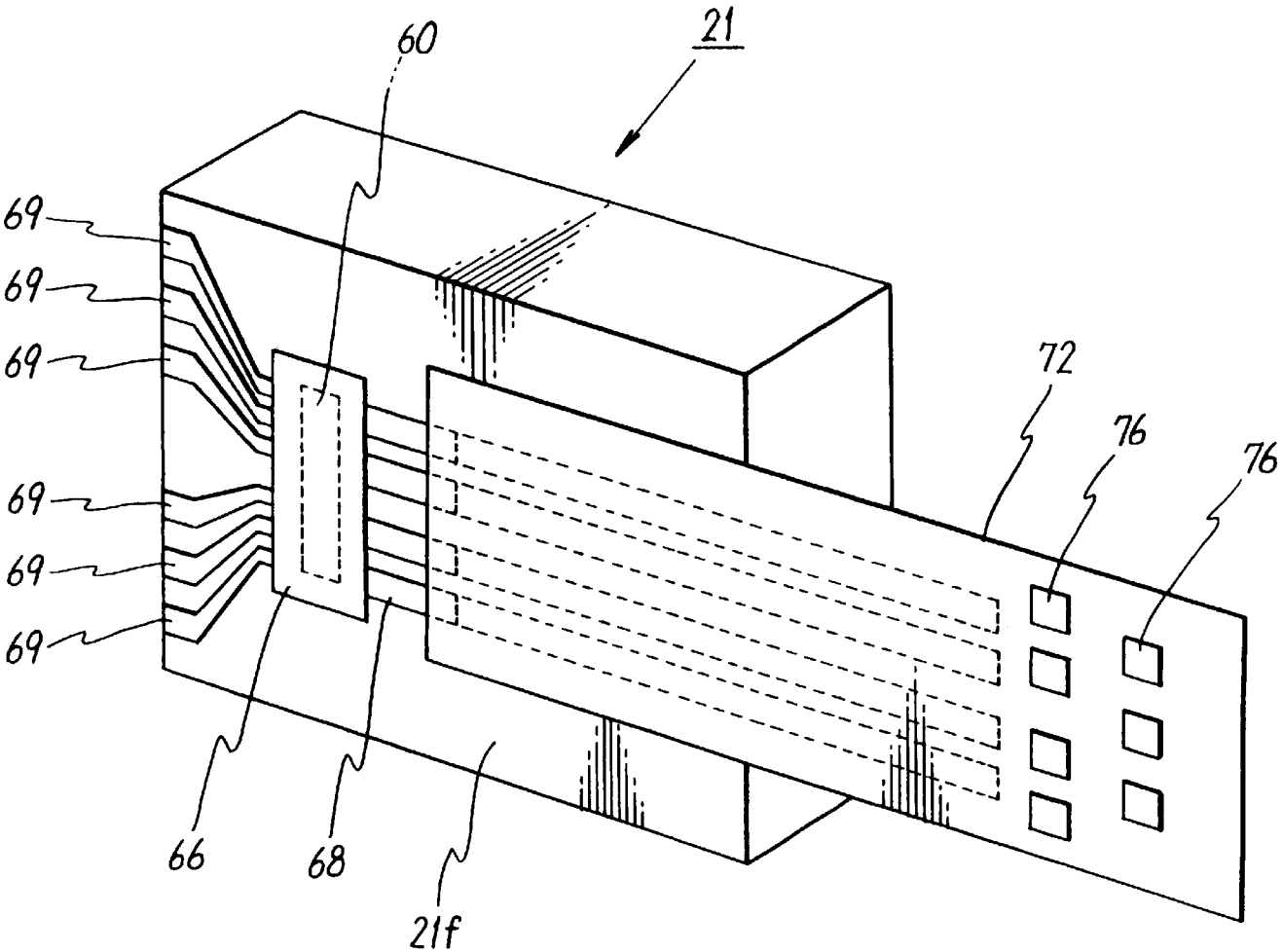
FIG. 5 illustratively shows a perspective view of an appearance of the head 21 as viewed from a side opposite to the nozzle plate 29.
Figure 6:
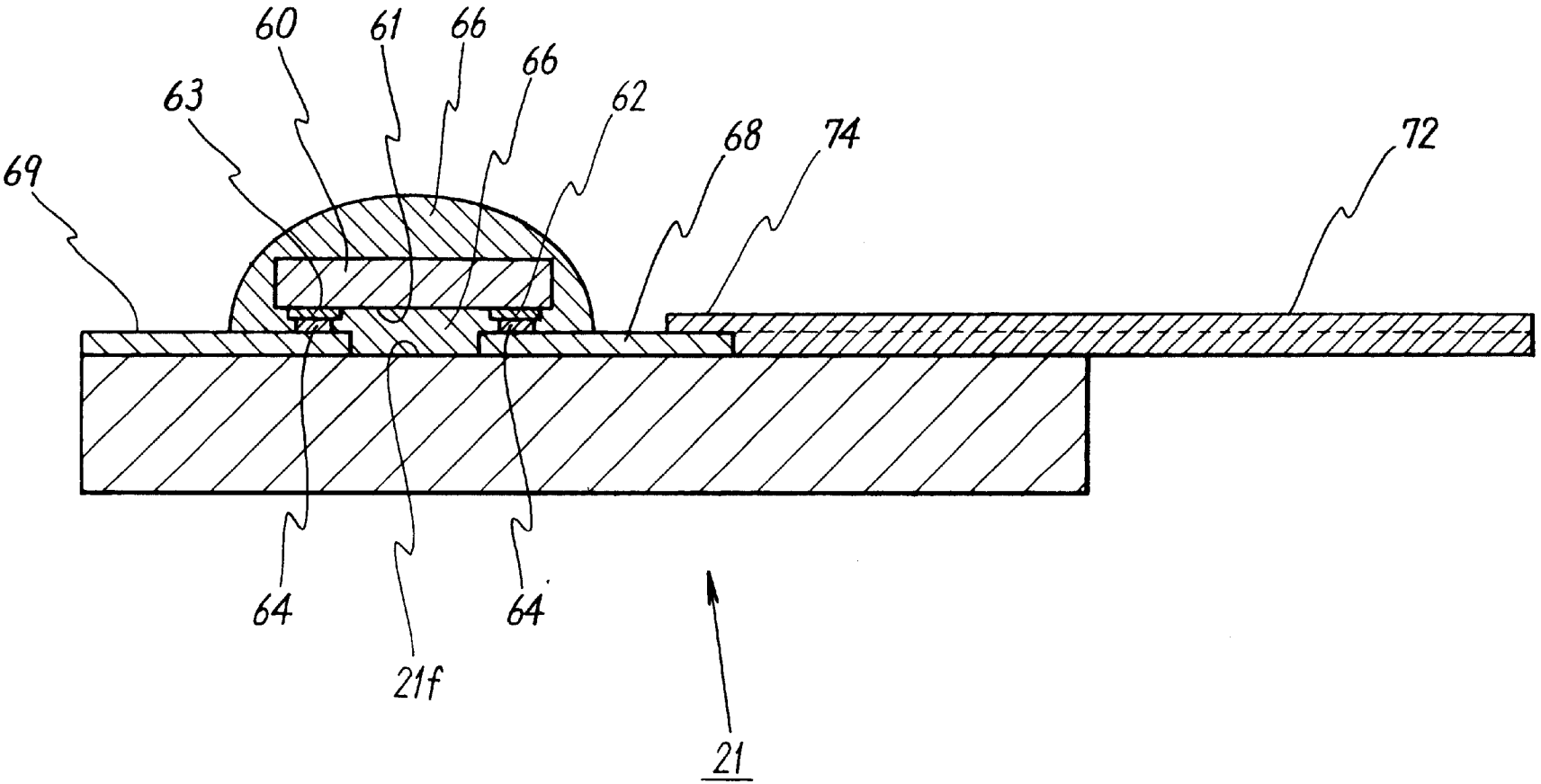
FIG. 6 illustratively shows a cross-sectional view of the head 21 shown in FIG. 5, as viewed from a side of the bottom of the head 21.
Figure 7:
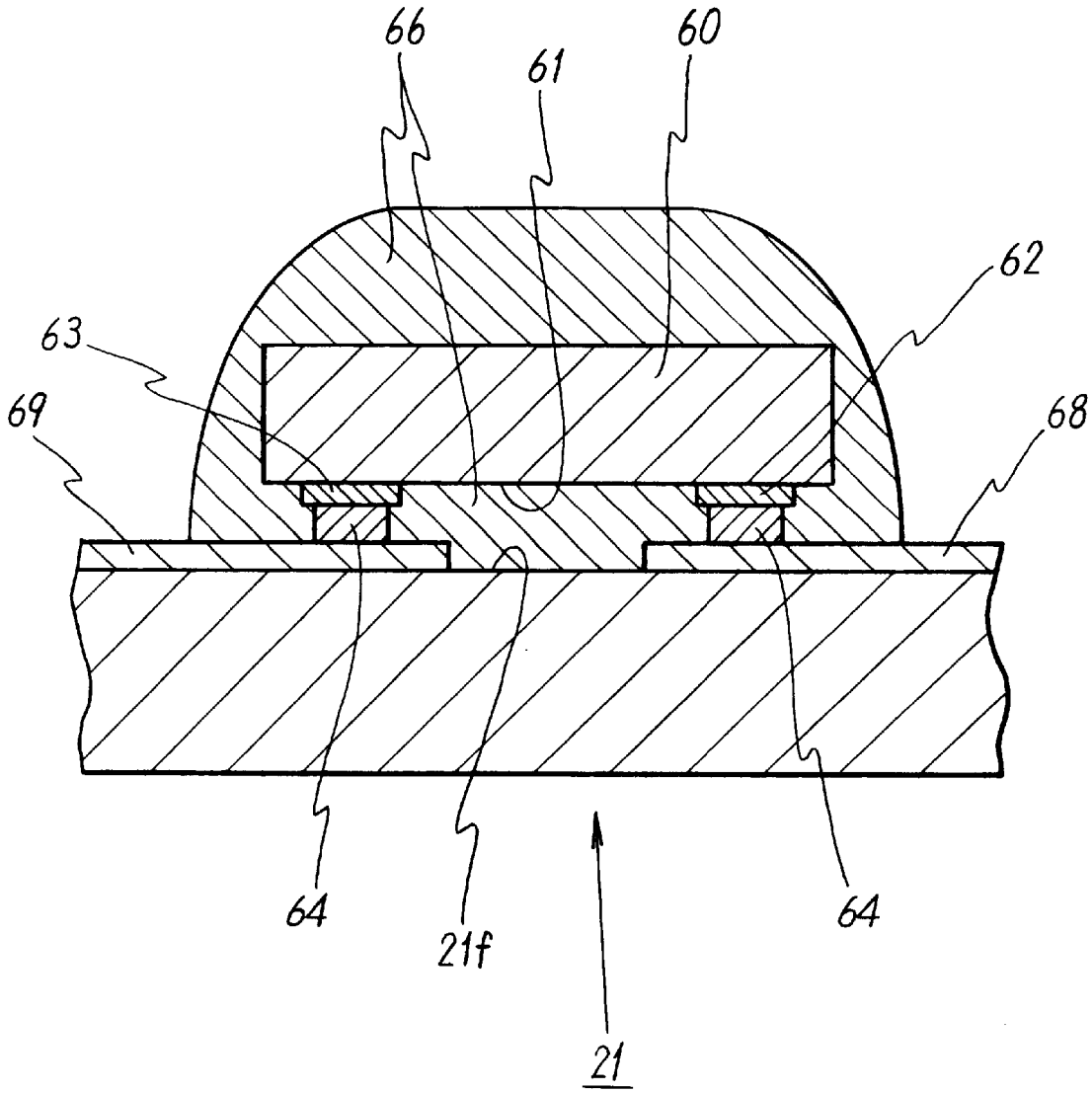
FIG. 7 illustratively shows an enlarged view of a part of the head 21 shown in FIG. 6.
Figure 8:
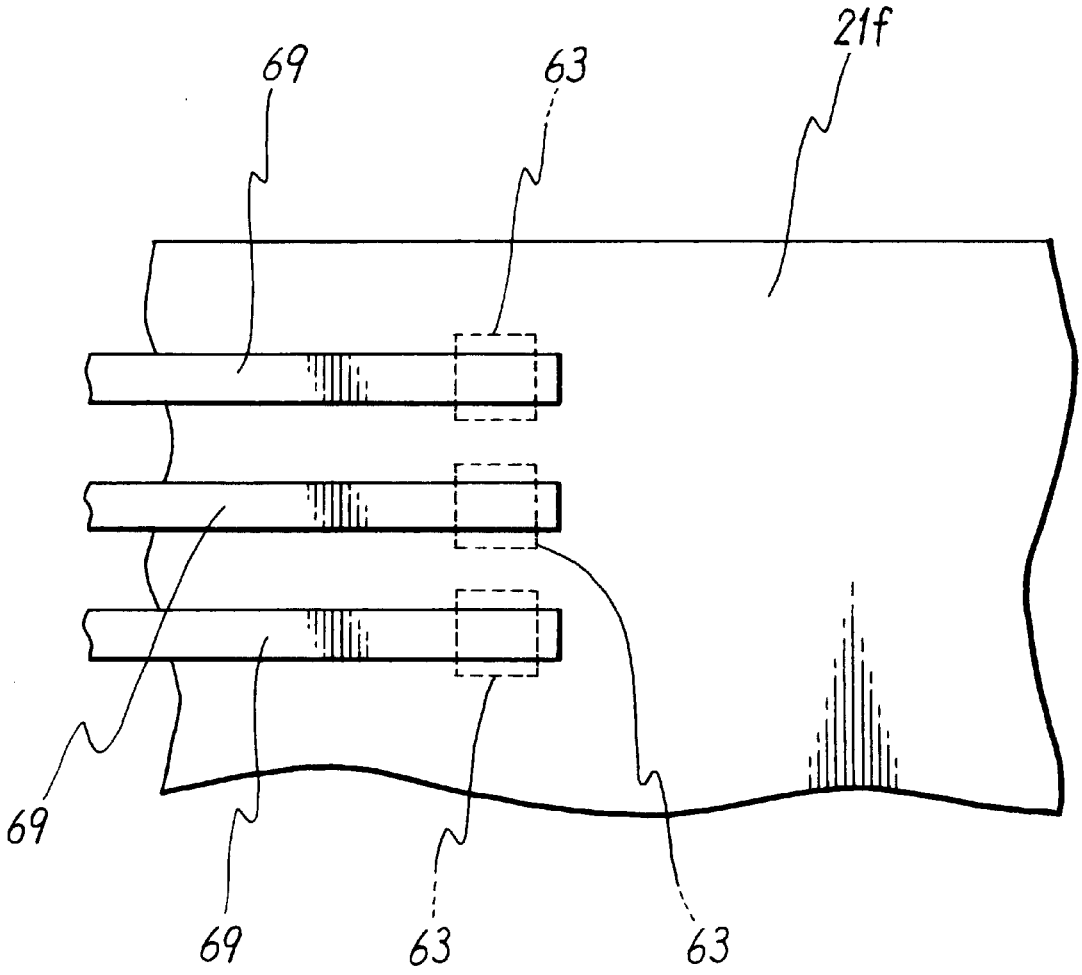
FIG. 8 illustratively shows parts of head electrodes formed on a side surface of the head 21.

The attachment structure of the ink-jet head and the IC chip is the same as those for the ink-jet heads 21 to 24. Accordingly, explanation will be made herein for the representative head 21. FIG. 5 illustratively shows a perspective view of an appearance of the head 21 as viewed from a side opposite to the nozzle plate 29. FIG. 6 illustratively shows a cross-sectional view of the head 21 shown in FIG. 5, as viewed from a side of the bottom of the head 21. FIG. 7 illustratively shows an enlarged view of a part of the head 21 shown in FIG. 6. FIG. 8 illustratively shows parts of head electrodes formed on a side surface of the head 21.

As shown in FIGS. 5 and 6, the IC chip 60, which contains the head-driving circuit 62*c* (see FIG. 2), is attached in an integrated manner to the side surface 21*f* of the head 21. Chip electrodes 62 on the input side and chip electrodes 63 on the output side are formed on the bottom surface 61 of the IC chip 60. Head electrodes 68 on the input side and head electrodes 69 on the output side are formed on the side surface 21*f* of the head 21. The head electrodes 68 on the input side are electrically connected to FPC 72 which is electrically connected to the control circuit 70 (see FIG. 2) through electrodes 76. The head electrodes 69 on the output side are electrically connected to the respective piezoelectric elements 21*c* (see FIG. 4).

As shown in FIGS. 6 and 7, bumps 64 made of metal are allowed to intervene between the chip electrodes 62 and the head electrodes 68 and between the chip electrodes 63 and the head electrodes 69 respectively.

Namely, the IC chip 60 is electrically connected to FPC 72 and the respective piezoelectric elements 21*c* through the bumps 64.

The surface of the IC chip 60 is covered with a potting material (sealing material) 66. The potting material 66 serves, for example, to shield light, avoid invasion of moisture, and ensure strength against external stress and stress caused by a difference in thermal expansion between the head 21 and the IC chip 60. Further, the potting material 66 is charged between the lower surface 61 of the IC chip 60 and the side surface 21*f* of the head 21.

Those obtained by plating a core made of copper with gold may be used as the bumps 64. An epoxy resin may be used as the potting material 66. Those obtained by stacking a thin gold film on a thin nickel film may be used as the head electrodes 68, 69. Electrodes made of aluminum may be used as the chip electrodes 62, 63. The side surface 21*f* corresponds to the one outer wall surface of the main head body according to the present invention. The lower surface 61 corresponds to the one surface of the IC chip according to the present invention.

Now, a method for attaching the head 21, the IC chip 60, and the FPC 72 will be explained with reference to FIG. 9 which shows attachment steps.

Figure 9:
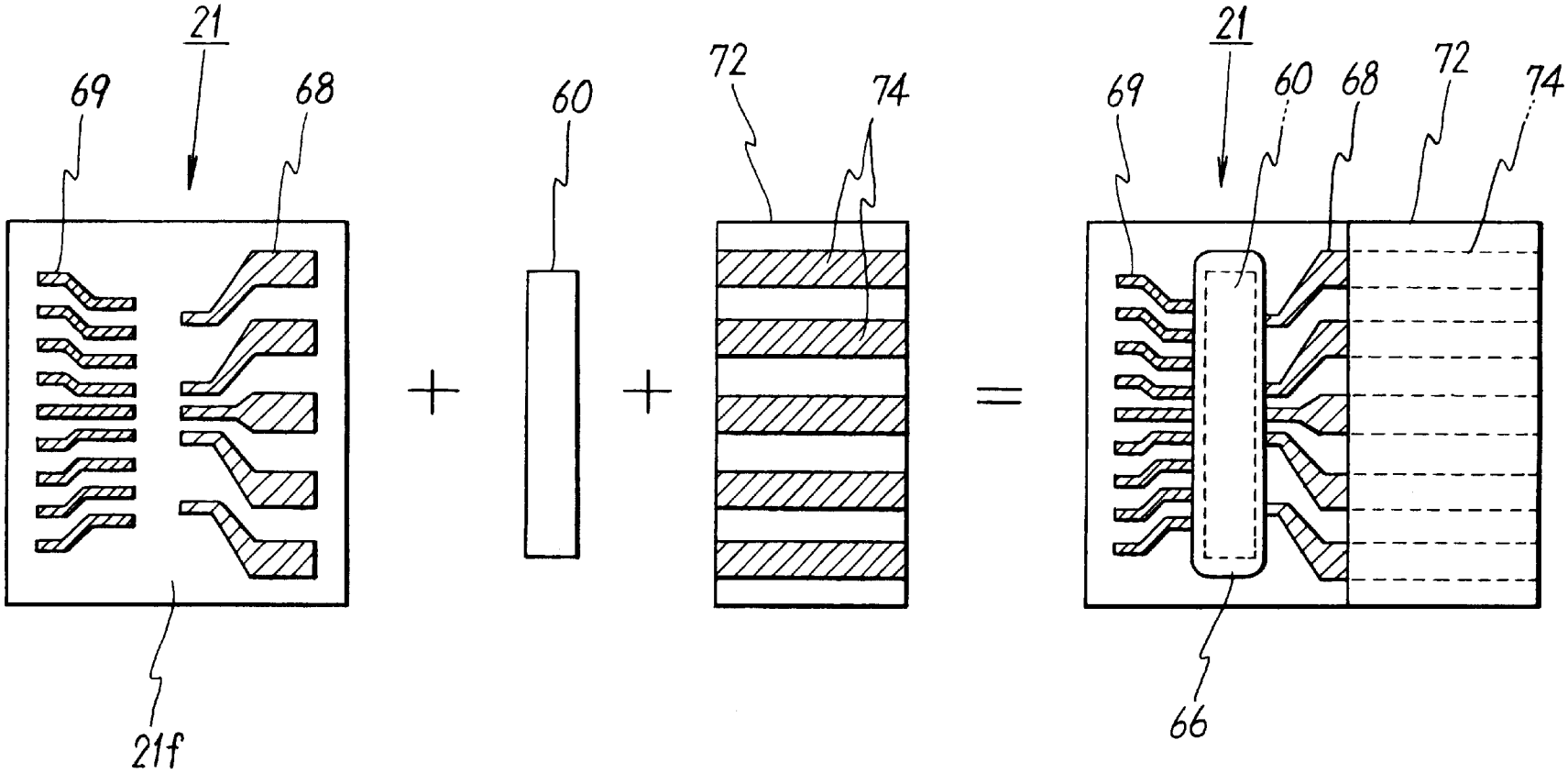
FIG. 9 shows steps for attaching the head 21, an IC chip 60, and FPC 72 used for the printer according to the first embodiment of the present invention.

At first, as shown in FIG. 9, the film-shaped head electrode 68, 69 are formed as patterns on the side surface 21*f* of the head 21. As shown in FIG. 7, the bumps 64 are attached to the lower surfaces of the chip electrodes 62, 63 of the IC chip 60 respectively.

The respective bumps 64 are placed on the head electrodes 68, 69, and the respective bumps 64 are joined to the head electrodes 68, 69. Subsequently, the surface of the IC chip 60 is covered with the potting material 66. The potting material 66 is charged between the lower surface 61 of the IC chip 60 and the side surface 21*f* of the head 21. The respective electrodes 74 of FPC 72 are electrically connected to the head electrodes 68 by the aid of a conductive adhesive or the like. The potting material 66 generally has a property that contracts upon curing. Accordingly, the lower surface 61 of the IC chip 60 and the side surface 21*f* of the head 21 are attracted to one another owing to the contractive force of the potting material 66 charged between the both. Thus, the chip electrodes 62 on the input side, the bumps 64, and the head electrode 68 on the input side are electrically connected in a reliable manner, and the chip electrodes 63 on the output side, the bumps 64, and the head electrode 69 on the output side are electrically connected in a reliable manner. In this embodiment, the joining between the IC chip 60 and the ink-jet head (main head body) is ensured by the contractive force of the potting material 66. Therefore, it is preferable to use a potting material such as an epoxy resin which makes remarkable contraction upon curing, for example, by heat or ultraviolet light.

As for the ink-jet heads 22 to 24 for the other colors, the IC chip 60 and FPC 72 are attached in accordance with the same attachment steps as described above.

As described above, the IC chip 60 is attached to the head 21 in the integrated manner by the aid of the potting material 66. Therefore, the heat generated in the IC chip 60 is transferred from the IC chip 60 to the side surface 21*f* of the head 21 through the potting material 66. The heat is further transferred to the ink contained in the ink chambers 21*d* (21*d*') formed inside the head 21. The heat is also transferred to the ink located in the ink supply passage extending from the ink cartridge 25 to the ink chambers 21*d*, and to the ink located in the ink flow passage extending from the ink chambers 21*d* to the nozzles 28. The heat generated in the IC chip 60 is radiated to the outside air through the potting material 66 which covers the surface of the IC chip 60. Further, the heat is radiated by the aid of the ink contained in the head 21 through the chip electrodes 62, 63, the bumps 64, 64, and the head electrodes 68, 69.

Namely, the IC chip 60 can be subjected to forced liquid cooling by using the ink contained in the head 21. Therefore, it is possible to improve the radiation efficiency, as compared with those based on natural cooling performed by using only the outside air for the IC chip 86, such as the conventional ink-jet head in which the IC chip 86 is not integrated with the head 80. According to the present invention, for example, the head-driving circuit 62 can be prevented from thermal destruction which would be otherwise caused by overheating of the IC chip 60.

As for the ink-jet heads 22 to 24 for the other colors, the attachment structure is the same as that of the head 21 and the IC chip 60 described above. Accordingly, the IC chip 60 can be subjected to forced liquid cooling by the aid of the ink contained in the ink-jet heads 22 to 24 respectively.

Next, a printer according to a second embodiment of the present invention will be explained with reference to FIGS. 10 and 11.

The printer according to this embodiment is characterized in that it is provided with an ink-jet head to which an IC chip 60 is attached in an integrated manner by gluing chip electrodes of the IC chip 60 and head electrodes of a head 21 to one another by the aid of a conductive adhesive.

Figure 10:
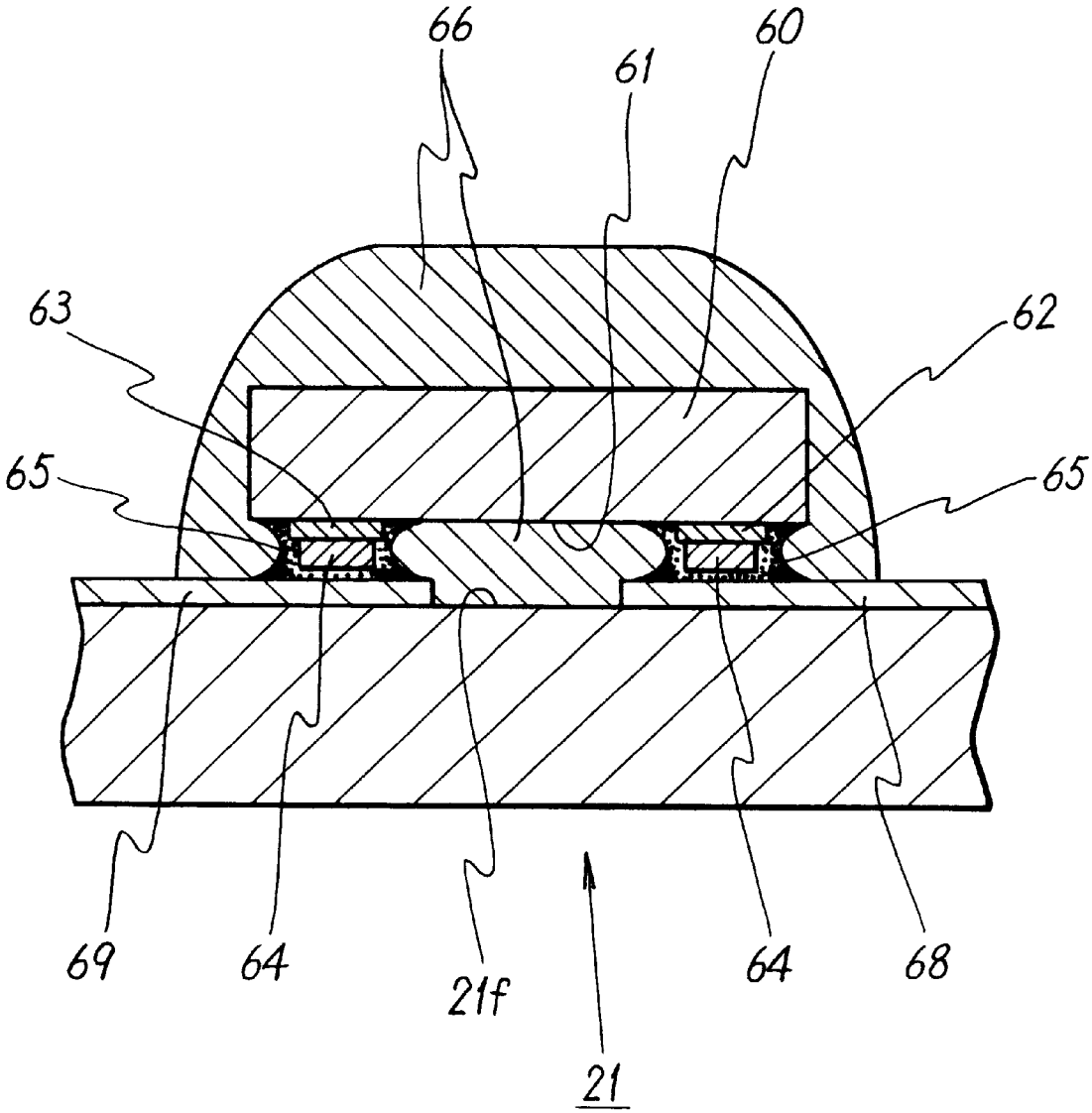
FIG. 10 illustratively shows a partial cross-sectional view of a structure of attachment of a head 21, an IC chip 60, and FPC 72 used for a printer according to a second embodiment of the present invention.
Figure 11A:
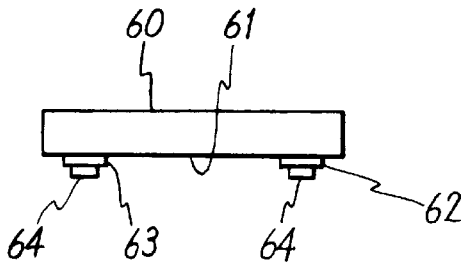
FIGS. 11A–D show steps for attaching the head 21, the IC chip 60, and FPC 72 shown in FIG. 10.
Figure 11B:
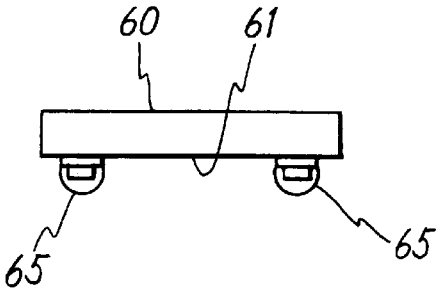
Figure 11C:
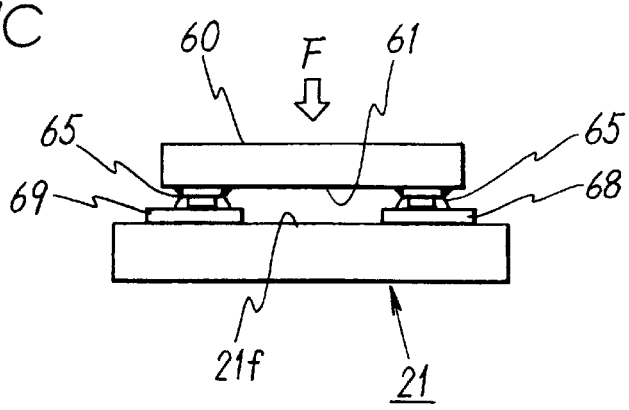
Figure 11D:
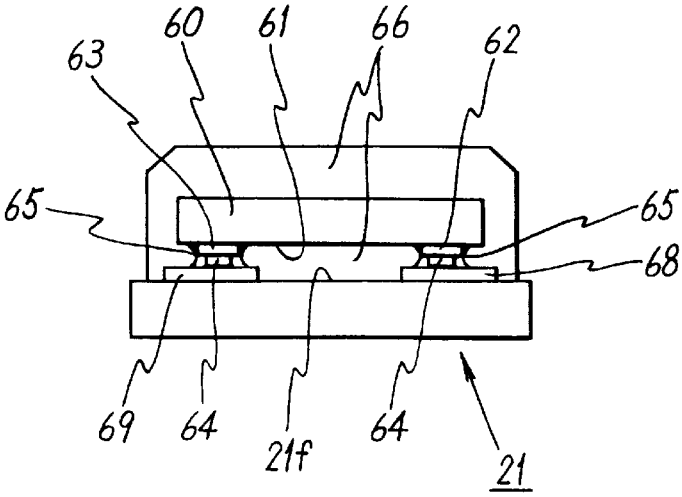

FIG. 10 illustratively shows a partial cross-sectional view of the attachment structure. FIG. 11 shows steps for attachment.

As shown in FIG. 11, the attachment steps are as follows. At first, the conductive adhesive 65 is allowed to adhere to lower surfaces of bumps 64, 64 attached to lower surfaces of the chip electrodes 62, 63 of the IC chip 60 respectively (steps A and B). Subsequently, the chip electrodes 62, 63 are placed on the head electrodes 68, 69 respectively. The upper surface of the IC chip 60 is pressed in the downward direction (direction indicated by an arrow F) so that the chip electrodes 62, 63 are glued to the head electrodes 68, 69 by the aid of the conductive adhesive 65 (step C). After that, the surface of the IC chip 60 is covered with a potting material 66, and the potting material 66 is charged between the lower surface 61 of the IC chip 60 and the side surface 21*f* of the head 21 (step D).

The IC chip 60 and the head 21 thus attached are shown in FIG. 10. As shown in FIG. 10, the respective bumps 64 are electrically connected to the head electrodes 68, 69 by the aid of the conductive adhesive 65 which is allowed to intervene between the lower surfaces of the bumps 64 and the head electrodes 68, 69. The conductive adhesive 65 is allowed to intervene around the respective bump 64 between the lower surface 61 of the IC chip 60 and the head electrodes 68, 69. The IC chip 60 is attached to the side surface 21*f* of the head 21 in an integrated manner by the aid of the conductive adhesive 65. Therefore, in this embodiment, it is not necessarily indispensable for the potting material 66 to exhibit any contractive property upon curing.

As described above, the conductive adhesive 65 makes it possible to electrically connect the IC chip 60 to the head electrodes 68, 69, and attach the IC chip 60 to the side surface 21*f* of the head 21 in the integrated manner. Accordingly, the IC chip 60 can be subjected to forced liquid cooling by using the ink contained in the head 21 by the aid of the potting material 66 which is allowed to intervene between the lower surface 61 of the IC chip 60 and the side surface 21*f* of the head 21.

As shown in FIG. 4 described above, the side surface 21*f* of the head 21 is perpendicular to wall surfaces (inner surfaces) 21*h* on which electrodes 21*e* of piezoelectric elements 21*c* are formed. Therefore, the head 21 has a structure which exhibits high strength against force acting along the wall surfaces 21*h*.

Therefore, even when the force to press the upper surface of the IC chip 60 in the downward direction acts in the step C described above, it is possible to avoid occurrence of any strain in the wall surfaces 21*h*, which would be otherwise caused by the force.

Next, a printer according to a third embodiment of the present invention will be explained with reference to FIGS. 12 and 13.

The printer according to this embodiment is characterized in that it is provided with an ink-jet head to which an IC chip 60 is attached in an integrated manner by gluing chip electrodes of the IC chip 60 and head electrodes of a head 21 by the aid of solder.

Figure 12:
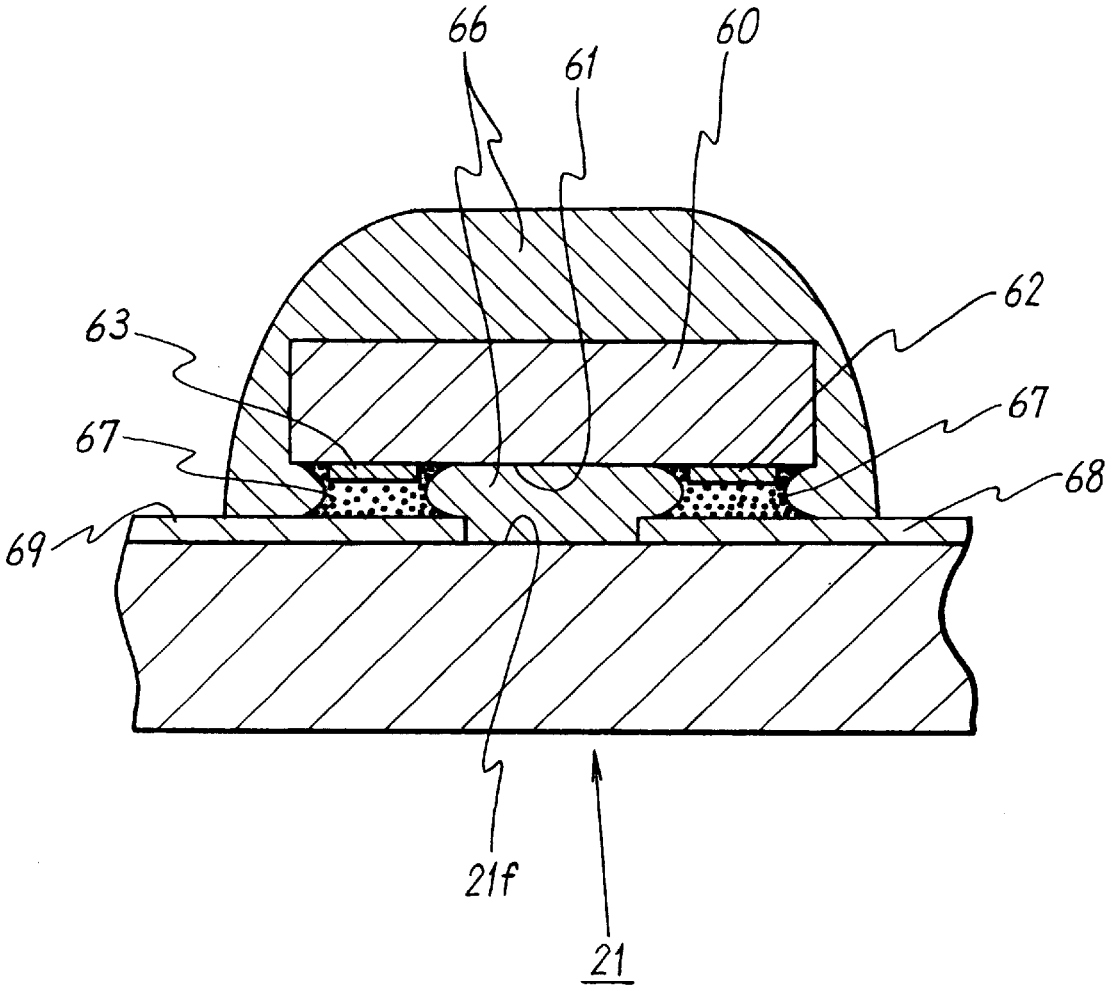
FIG. 12 illustratively shows a partial cross-sectional view of a structure of attachment of a head 21, an IC chip 60, and FPC 72 used for a printer according to a third embodiment of the present invention.
Figure 13A:
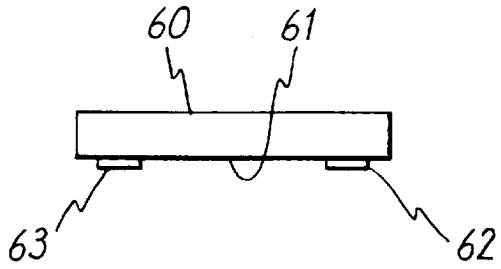
FIGS. 13A–D show steps for attaching the head 21, the IC chip 60, and FPC 72 shown in FIG. 12.
Figure 13B:
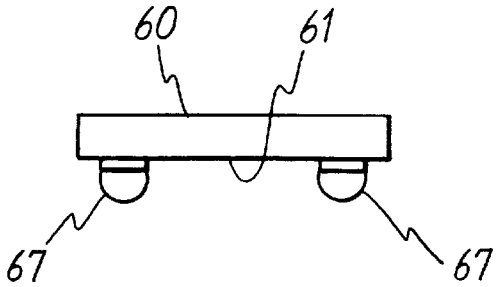
Figure 13C:
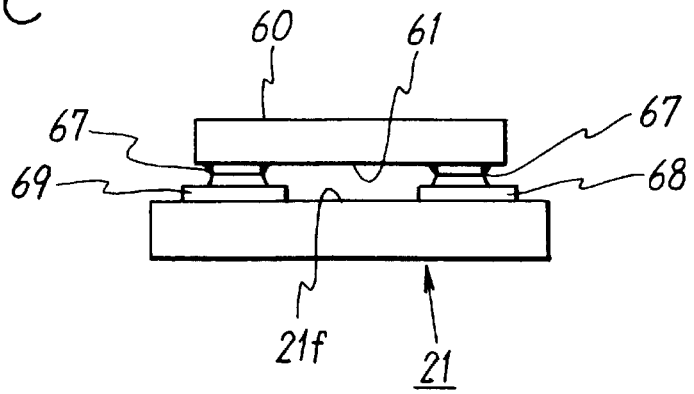
Figure 13D:
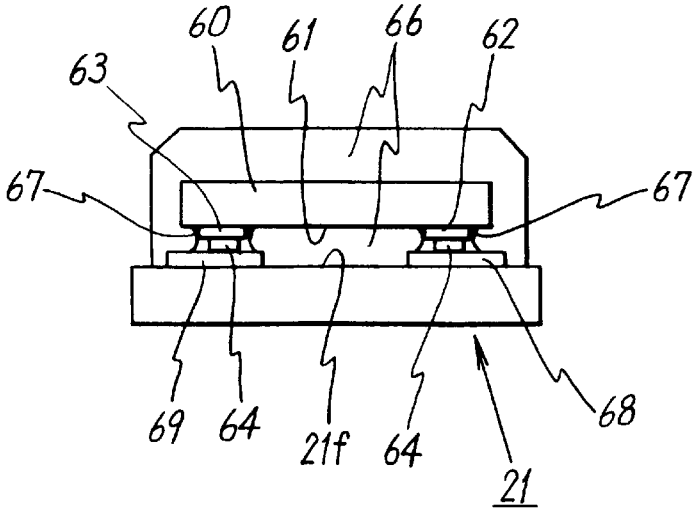

FIG. 12 illustratively shows a partial cross-sectional view of the attachment structure. FIG. 13 shows steps for attachment.

As shown in FIG. 13, the attachment steps are as follows. At first, the solders 67 are affixed to lower surfaces of the chip electrodes 62, 63 of the IC chip 60 respectively (steps A and B). Subsequently, the solders 67, 67 are placed on the head electrodes 68, 69 respectively. The solders 67, 67 are heated and melted to join the chip electrodes 62, 63 to the head electrodes 68, 69 (step C). After that, the surface of the IC chip 60 is covered with a potting material 66, and the potting material 66 is charged between the lower surface 61 of the IC chip 60 and the side surface 21*f* of the head 21 (step D).

The IC chip 60 and the head 21 thus attached are shown in FIG. 12. As shown in FIG. 12, the chip electrodes 62, 63 are electrically connected to the head electrodes 68, 69 by the aid of the solders 67. The solders 67 are allowed to intervene around the chip electrodes 62, 63 between the lower surface 61 of the IC chip 60 and the head electrodes 68, 69. The IC chip 60 is attached to the side surface 21*f* of the head 21 in an integrated manner by the aid of the solders 67.

As described above, the solders 67 make it possible to electrically connect the IC chip 60 to the head electrodes 68, 69, and attach the IC chip 60 to the side surface 21*f* of the head 21 in the integrated manner. Accordingly, the IC chip 60 can be subjected to forced liquid cooling by using the ink contained in the head 21 by the aid of the potting material 66 which is allowed to intervene between the lower surface 61 of the IC chip 60 and the side surface 21*f* of the head 21.

Alternatively, the following procedure may be available. Namely, bumps 64 are attached to the lower surface of the chip electrodes 62, 63. The solders 67 are provided on the head electrodes 68, 69. The solders 67 are heated and melted to join the head electrodes 68, 69 to the chip electrodes 62, 63, followed by the steps in which the surface of the IC chip 60 is covered with the potting material 66, and the potting material 66 is charged between the lower surface 61 of the IC chip 60 and the side surface 21*f* of the head 21. Thus, the IC chip 60 is attached to the head 21 in an integrated manner. The IC chip 60 is subjected to forced liquid cooling by using the ink contained in the head 21 by the aid of the potting material 66.

In the respective foregoing embodiments, the IC chip 60 is fixedly secured to the head 21 by using the conductive adhesive or the solder. Alternatively, the IC chip 60 and the head 21 are integrated and fixedly secured to one another by charging a UV-curable resin between the lower surface 61 of the IC chip 60 and the side surface 21*f* of the head 21.

According to the foregoing procedure, the heat generated in the IC chip 60 can be transferred to the head 21 through the UV-curable resin. Further, the difference in thermal expansion, which occurs between the IC chip 60 and the head 21, can be absorbed by the UV-curable resin.

Figure 14:
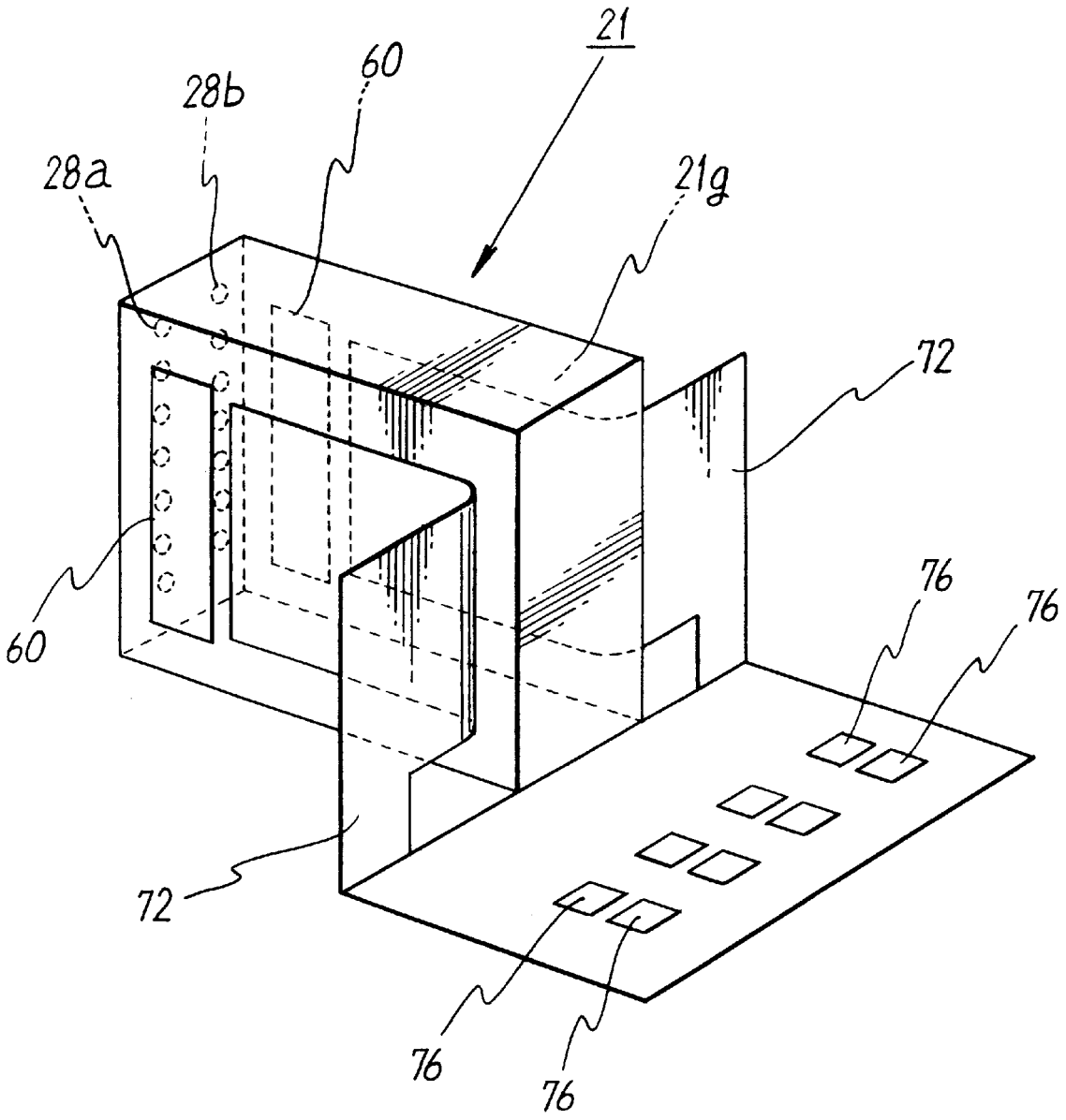
FIG. 14 illustratively shows a perspective view of an appearance concerning a state in which IC chips 60 are attached to both side surfaces 21*f*, 21*g* of a head 21 in an integrated manner respectively.

As shown in FIG. 14, when a head 21 has a nozzle plate 29 comprising two arrays of nozzles 28*a*, 28*b* formed in the vertical direction, IC chips 60 for driving the nozzles 28*a*, 28*b* can be attached in an integrated manner to both side surfaces 21*f*, 21*g* respectively in accordance with the attachment steps described above.

In this arrangement, it is a matter of course that the respective IC chips 60 can be subjected to forced liquid cooling by using the ink contained in the head 21.

A printer according to a fourth embodiment of the present invention will be explained with reference to FIGS. 15 and 16. The printer according to this embodiment is characterized in that it is provided with an ink-jet head in which an IC chip 60 is affixed to an outer circumferential section of a printer head 21 by gluing chip electrodes of the IC chip 60 and head electrodes of the head 21 to one another by the aid of an anisotropic conductive material.

Figure 15:
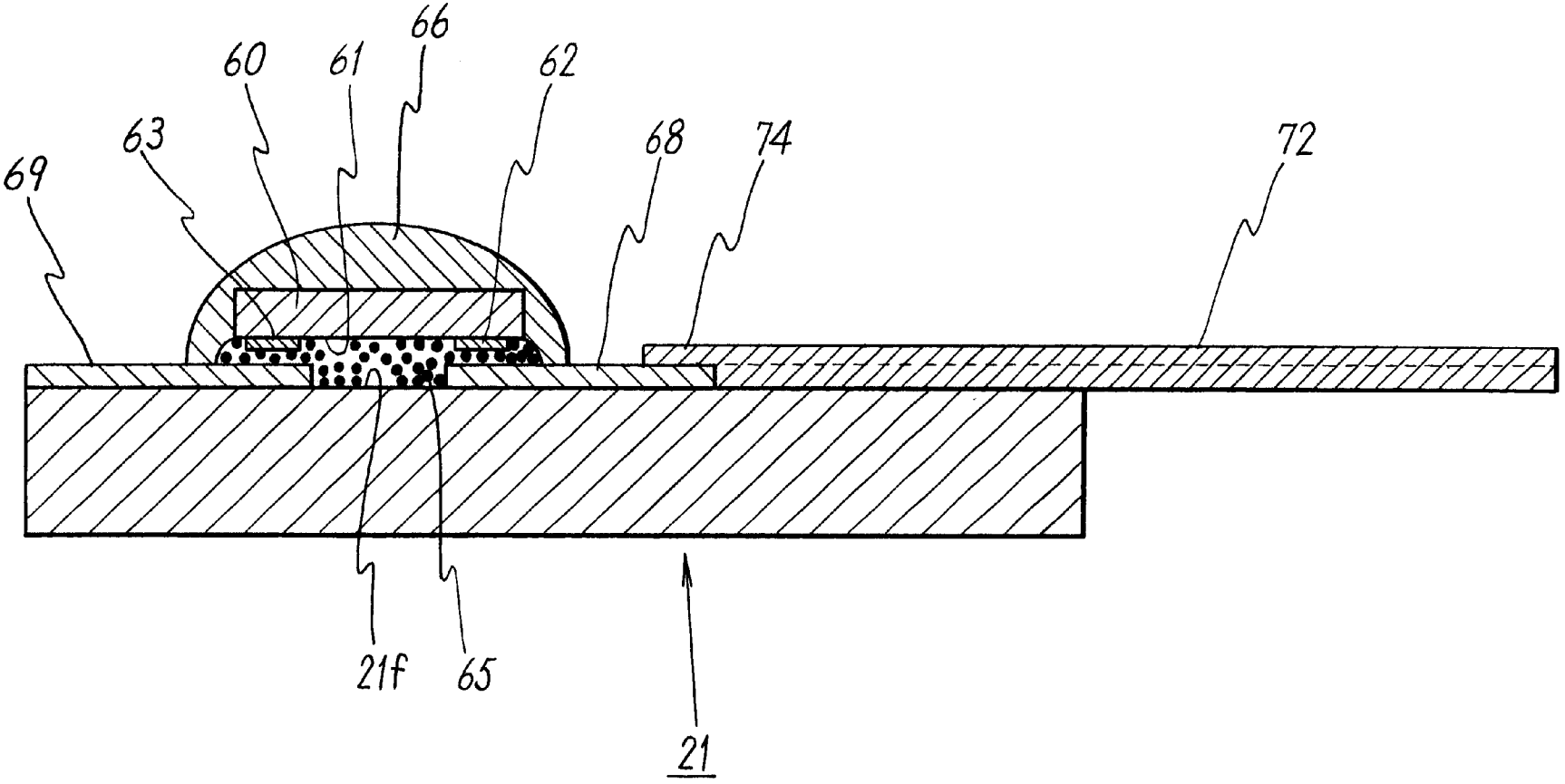
FIG. 15 illustratively shows a cross-sectional view of a head 21 according to a fourth embodiment of the present invention, as viewed from a side of the bottom of the head 21.
Figure 16:
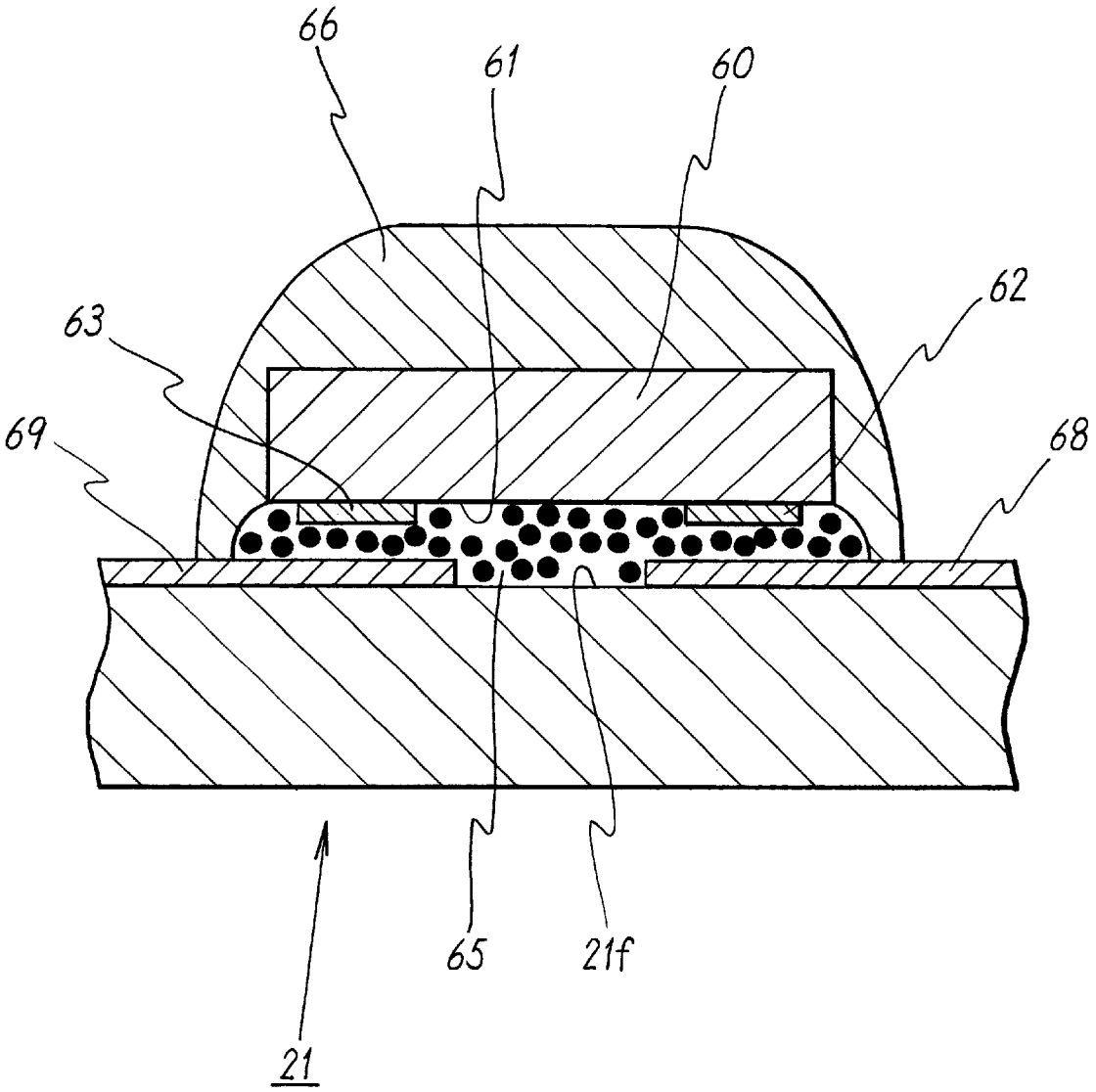
FIG. 16 illustratively shows an enlarged view of a part of the head 21 shown in FIG. 15.

As shown in FIGS. 15 and 16, the anisotropic conductive material 65 is charged between the lower surface 61 of the IC chip 60 and the side surface 21*f* of the head 21. The IC chip 60 is fixedly secured to the side surface 21*f* of the head 21 by the aid of the anisotropic conductive material 65. The chip electrodes 62 are electrically connected to the head electrodes 68 through the anisotropic conductive material 65.

Namely, the IC chip 60 is electrically connected to FPC 72 and the respective piezoelectric elements 21*c* through the anisotropic conductive material 65.

The surface of the IC chip 60 is covered with a potting material (sealing material) 66. The potting material 66 serves, for example, to shield light, avoid invasion of moisture, and ensure strength against external stress and stress caused by a difference in thermal expansion between the head 21 and the IC chip 60.

In this embodiment, the anisotropic conductive material 65 may be, for example, a material created by dispersing particles of a conductor such as nickel and silver, resin balls coated with a conductive film (for example, Au film), or conductive resin balls, in an epoxy resin adhesive.

It is also possible to use those obtained by dispersing, in an epoxy resin adhesive, conductive plastic balls formed by mixing particles of a conductive substance such as Au with particles of resin, carbon or the like. Alternatively, a tape-shaped anisotropic conductive material may be used. In this case, the tape-shaped anisotropic conductive material itself has no adhesive property. Therefore, it is necessary that the tape-shaped anisotropic conductive material is arranged between the chip electrodes 62 and the head electrodes 68, followed by pressing, heating, and cooling, and then the entire portion is covered with the potting material.

An epoxy resin is used as the potting material 66. Those obtained by stacking a gold thin film on a nickel thin film are used as the head electrodes 68, 69. Electrodes made of aluminum are used as the chip electrodes 62, 63.

The side surface 21*f* corresponds to the one outer wall surface of the ink-jet head according to the present invention. The lower surface 61 corresponds to the one surface of the IC chip.

Now, a method for attaching the head 21, the IC chip 60, and the FPC 72 will be explained with reference to FIGS. 9 and 17 which show attachment steps.

At first, as shown in FIG. 9, the film-shaped head electrode 68, 69 are formed as patterns on the side surface 21*f* of the head 21.

Figure 17A:
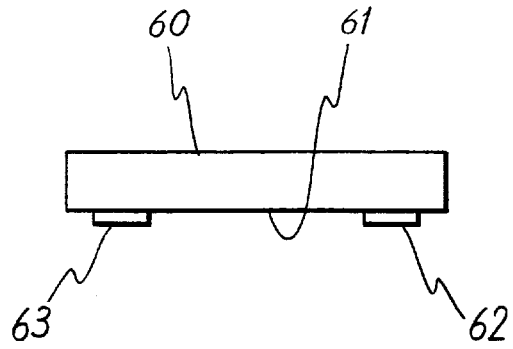
FIGS. 17A–C show steps for attaching an IC chip 60 to the head 21 by using an anisotropic conductive material.
Figure 17B:
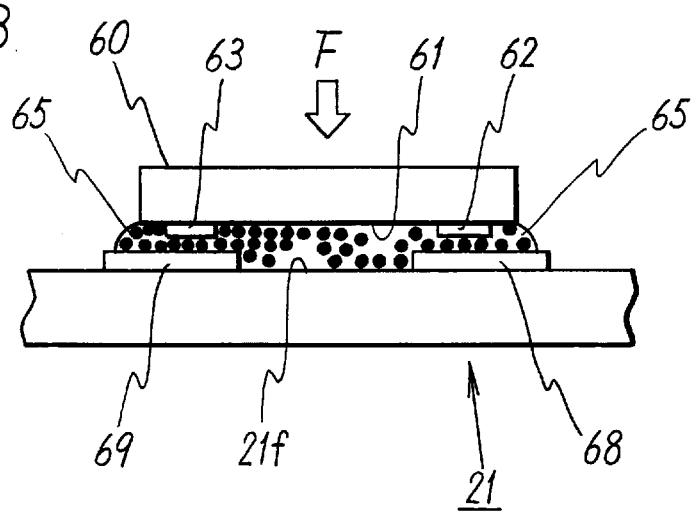
Figure 17C:
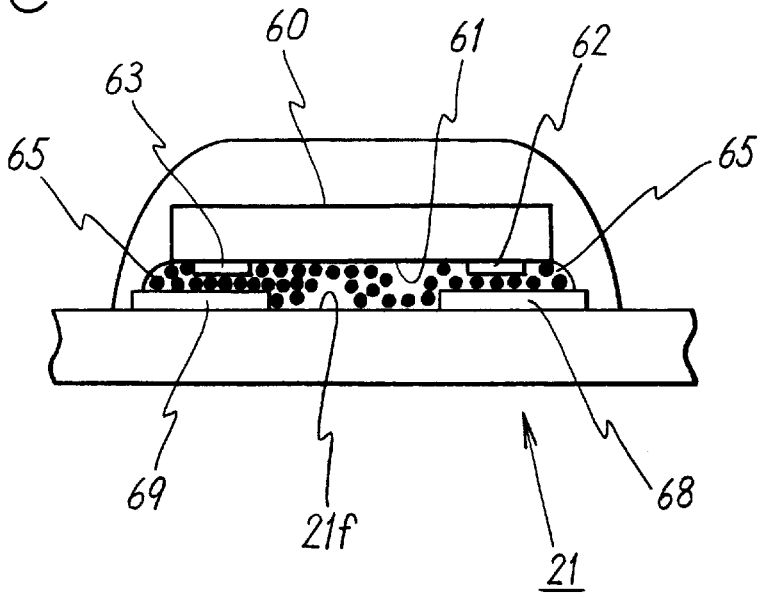
Figure 18:
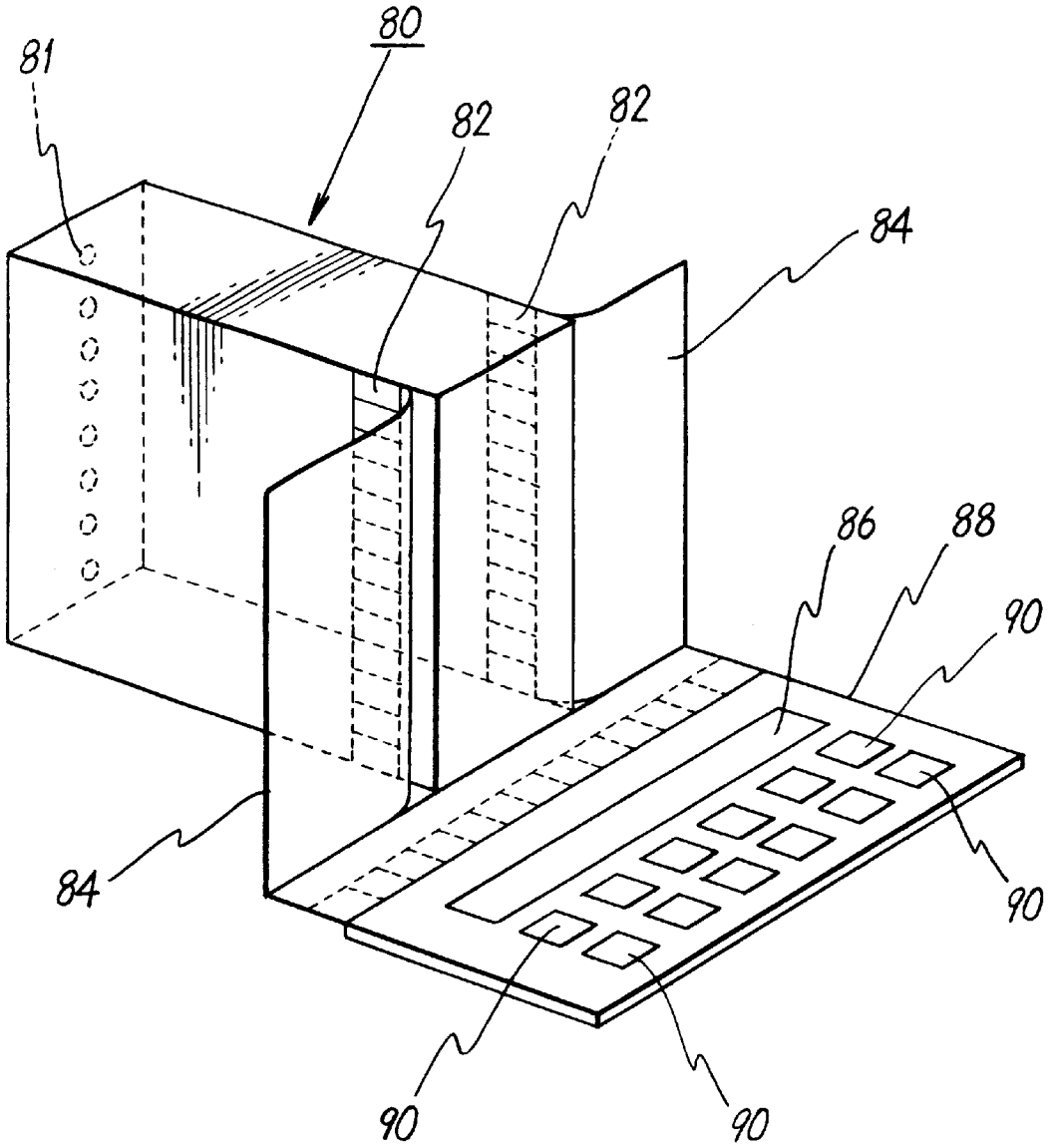
FIG. 18 PRIOR ART
FIG. 18 illustratively shows a perspective view of an appearance of a conventional structure of attachment of a head, an IC chip, and FPC.

As shown in FIG. 17, the anisotropic conductive material 65 is applied as a film having a predetermined thickness on the side surface 21*f* of the head 21 to cover the head electrodes 68, 69. A pressure is applied against the upper surface of the IC chip 60 in a downward direction (direction indicated by an arrow F in FIG. 17) by using a pressing machine (steps A and B). During this process, the applied pressure allows conductor particles contained in the anisotropic conductive material 65 to contact with each other. Accordingly, the upper and lower surface of the anisotropic conductive material 65 are changed into a state in which electric continuity is established therebetween. Further, the IC chip 60 is fixedly secured to the side surface 21*f* of the head 21 by the aid of the adhesive force of the epoxy resin adhesive contained in the anisotropic conductive material 65.

After that, the surface of the IC chip 60 is covered with the potting material 66 (step C).

As for the ink-jet heads 22 to 24 for the other colors, the IC chip 60 and FPC 72 are attached in accordance with the same attachment steps as described above.

As described above, the IC chip 60 is attached to the head 21 in the integrated manner by the aid of the anisotropic conductive material 65. Therefore, the heat generated in the IC chip 60 is transferred from the IC chip 60 to the side surface 21*f* of the head 21 through the anisotropic conductive material 65. The heat is further transferred to the ink contained in the ink chambers 21*d* formed inside the head 21. The heat is also transferred to the ink located in the ink supply passage extending from the ink cartridge 25 to the ink chambers 21*d*, and to the ink located in the ink flow passage extending from the ink chambers 21*d* to the nozzles 28. Further, the heat generated in the IC chip 60 is radiated to the outside air through the potting material 66 which covers the surface of the IC chip 60.

The IC chip 60 can be electrically connected to the head 21 and the IC chip 60 can be attached to the head 21 in the integrated manner in accordance with the steps comprising only forming the film of the anisotropic conductive material 65 on the side surface 21*f* of the head 21, providing the IC chip 60 thereon, and pressing the IC chip 60 in the downward direction.

Namely, the IC chip 60 can be electrically connected and attached to the head 21 in a more convenient manner as compared with those in which the chip electrodes 62, 63 are electrically connected to the head electrodes 68, 69 by the aid of the metallic bumps or the solder. According to the fourth embodiment of the present invention, the IC chip is not damaged by heat because it is unnecessary to perform any heating for making connection.

The IC chip 60 can be subjected to forced liquid cooling by using the ink contained in the head 21. Accordingly, it is possible to improve the radiation efficiency, as compared with those based on natural (air) cooling performed by using only the outside air for the IC chip 86, such as the conventional ink-jet head in which the IC chip 86 is not integrated with the head 80. According to the present invention, for example, the head-driving circuit 62 can be prevented from thermal destruction which would be otherwise caused by overheat of the IC chip 60.

AS for the ink-jet heads 22 to 24 for the other colors, the attachment structure is the same as that of the head 21 and the IC chip 60 described above. Accordingly, the IC chip 60 can be subjected to forced liquid cooling by using the ink contained in the ink-jet heads 22 to 24 respectively.

As shown in FIG. 4 described above, the side surface 21*f* of the head 21 is perpendicular to wall surfaces (inner surfaces) 21*h* on which electrodes 21*e* of piezoelectric elements 21*c* are formed. Therefore, the head 21 has a structure which exhibits high strength with respect to force acting against the wall surfaces 21*h*.

Therefore, even when the force for pressing against the upper surface of the IC chip 60 in the downward direction acts in the step B described above, it is possible to avoid occurrence of any strain in the wall surfaces 21*h*, which would be otherwise caused by the force.

As shown in FIG. 14, when a head 21 has a nozzle plate 29 comprising two arrays of nozzles 28*a*, 28*b* formed in the vertical direction, IC chips 60 for driving the nozzles 28*a*, 28*b* can be attached in an integrated manner to both side surfaces 21*f*, 21*g* respectively in accordance with the attachment steps described above.

In this arrangement, it is a matter of course that the respective IC chips 60 can be subjected to forced liquid cooling by using the ink contained in the head 21.

In the foregoing respective embodiments, explanation has been made for the case in which the present invention is applied to the color ink-jet printer. Although the structure of the color ink-jet printer has been described above (in FIGS. 1 and 2), the detailed structure of the printer is also disclosed in U.S. Pat. No. 5,182,582, the content of which is incorporated herein by reference. However, the present invention can be preferably applied to other types of printers based on the use of displacement of piezoelectric elements, for example, a printer disclosed in U.S. Pat. No. 5,146,236, the content of which is incorporated herein by reference. The present invention can also be applied to a printer using laminate-type piezoelectric elements, for example, a printer disclosed in U.S. Pat. No. 5,128,694, the content of which is incorporated herein by reference.

According to the ink-jet head concerning the first aspect of the present invention and the ink-jet recording apparatus concerning the second aspect of the present invention, the heat generated in the IC chip can be transferred to the ink-jet head (main head body) and to the ink contained in the ink chambers and other components via the resin material such as the potting material. As a result of discharge of the ink from the nozzles, the heat generated in the IC chip can be efficiently radiated to the outside of the ink-jet head. According to the ink-jet head and the ink-jet recording apparatus, the heat can be efficiently radiated via the resin charged between the opposing surfaces of the main head body and the IC chip. Further, the heat generated from the IC chip can be radiated out of the chip electrodes and the head electrodes. The head electrodes and the chip electrodes are electrically connected to one another by the aid of the conductive adhesive or the solder. Thus, the IC chip can be fixedly secured to the outer wall surface of the main head body by the aid of the conductive adhesive or the solder, and the heat generated from the IC chip can be radiated through the conductive adhesive or the solder.

According to the ink-jet head concerning the third aspect of the present invention and the ink-jet recording apparatus concerning the fourth aspect of the present invention, the IC chip is attached to the outer wall surface of the main head body via the anisotropic conductive material intervened therebetween. Accordingly, the heat generated in the IC chip can be transferred to the ink-jet head (main head body) and to the ink contained therein through the anisotropic conductive material. As a result of discharge of the ink from the nozzles, the head generated in the IC chip can be efficiently radiated to the outside of the ink-jet head. The anisotropic conductive material exhibits the remarkable conductive behavior in a specified direction. Accordingly, in addition to the heat radiation effect described above, the driving circuit can be electrically connected to the piezoelectric elements only by allowing the anisotropic conductive material to intervene between the IC chip and the outer wall surface of the main head body, and pressing the anisotropic conductive materiel in the thickness direction. Further, owing to the adhesive property possessed by the anisotropic conductive material, the one outer wall surface of the main head body and the one surface of the IC chip can be fixedly secured to one another by the aid of the anisotropic conductive material.

Therefore, the ink-jet head and the ink-jet recording apparatus according to the present invention are excellent in heat radiation efficiency as compared with the conventional ink-jet head in which the heat of the IC chip is naturally radiated. The IC chip, which includes the circuit for driving the piezoelectric elements in the inkjet head, can be prevented from damage which would be otherwise caused by overheat. Further, the ink-jet head and the ink-jet recording apparatus according to the present invention are produced extremely easily.

According to the method for installing the IC chip to the ink-jet head of the present invention, the anisotropic conductive material having the adhesive property is charged between the ink-jet head and the IC chip so that the both are joined to one another. Accordingly, it is unnecessary to provide any conductive material such as solder for making continuity with limitation to the chip electrode portions and the head electrode portions. It is sufficient that the anisotropic conductive material is merely charged over a broad region ranging between the ink-jet head and the IC chip. In order to obtain continuity between the chip electrodes and the head electrodes, a pressure is merely applied in the direction to allow the ink-jet head to approach the IC chip. Therefore, it is possible to install the IC chip to the ink-jet head extremely easily. Moreover, when the anisotropic conductive material has the adhesive property, it is unnecessary to use any adhesive or the like for gluing the IC chip to the ink-jet head, and it is possible to reduce the production cost.

The present invention may be practiced or embodied in other various forms without departing from the spirit or essential characteristics thereof. It will be understood that the scope of the present invention is indicated by the appended claims, and all variations and modifications concerning, for example, the type of the ink-jet printer and the presence or absence of bumps upon soldering, which come within the equivalent range of the claims, are embraced in the scope of the present invention.

What is claimed is:

1. An ink-jet head comprising:

a main head body including ink chambers formed therein;

piezoelectric elements for changing a volume of each of the ink chambers in accordance with application of a driving voltage; and an IC chip including a driving circuit for driving the piezoelectric elements, wherein the IC chip is attached to an outer wall surface of the main head body by way of a resin material intervened therebetween such that at least one of the ink chambers is disposed under the IC chip, the resin material being thermally conductive to radiate heat away from the IC chip to the ink-jet head.

2. The ink-jet head according to claim 1, wherein the IC chip is attached to a cover plate or a piezoelectric ceramic plate for constructing the main head body, via the resin material intervened therebetween.

3. The ink-jet head according to claim 1, wherein the resin is an epoxy resin.

4. The ink-jet head according to claim 1, wherein:

he a d electrodes connected to the piezoelectric elements are formed on one outer wall surface of the main head body, and chip electrodes electrically connected to the driving circuit are formed on one surface of the IC chip; and the IC chip is attached to the outer wall surface of the main head body so that the one outer wall surface of the main head body is opposed to the one surface of the IC chip, and the head electrodes are electrically connected to the chip electrodes, and the resin is charged between the one outer wall surface of the main head body and the one surface of the IC chip.

5. The ink-jet head according to claim 4, wherein the head electrodes and the chip electrodes are electrically connected to one another by a conductive adhesive, whereby the IC chip is attached to the outer wall surface of the main head body.

6. The ink-jet head according to claim 4, wherein the head electrodes and the chip electrodes are electrically connected to one another by solder.

7. The ink-jet head according to claim 4, wherein the ink chambers are comparted by walls composed of the piezoelectric elements, and the walls composed of the piezoelectric elements are perpendicular to the one outer wall surface of the main head body.

8. The ink-jet head according to claim 4, further comprising an ink cartridge.

9. The ink-jet head according to claim 1, wherein the IC chip is attached to the outer wall surface of the main head body via the resin material intervened therebetween, and the IC chip is covered with the resin material.

10. The ink-jet head of claim 1, wherein the IC chip includes electrodes and the IC chip is thermally connected to the main head body by the resin material on surface portions of the IC chip at locations in addition to the electrodes.

11. An ink-jet head comprising:

a main head body including ink chambers formed therein;

piezoelectric elements for changing a volume of each of the ink chambers in accordance with application of a driving voltage; and an IC chip including a driving circuit for driving the piezoelectric elements, wherein the IC chip is attached to an outer surface of the main head body by way of an anisotropic conductive material intervened therebetween such that at least one of the ink chambers is disposed under the IC chip, whereby the driving circuit is electrically connected to the piezoelectric elements.

12. The ink-jet head according to claim 11, wherein the driving circuit is electrically connected to the piezoelectric elements by pressing the anisotropic conductive material in a direction to allow the driving circuit-to approach the piezoelectric elements.

13. The ink-jet head according to claim 12, wherein:

head electrodes connected to the piezoelectric elements are formed on one outer wall surface of the main head body, and chip electrodes electrically connected to the driving circuit are formed on one surface of the IC chip; and the one outer wall surface of the main head body is opposed to the one surface of the IC chip, and the anisotropic conductive material is charged between the one outer wall surface of the main head body and the one surface of the IC chip so that the driving circuit is electrically connected to the piezoelectric elements.

14. The ink-jet head according to claim 12, wherein the anisotropic conductive material has an adhesive property, and the one outer wall surface of the main head body is glued to the one surface of the IC chip by the aid of the anisotropic conductive material.

15. The ink-jet head according to claim 14, wherein the anisotropic conductive material is a material obtained by dispersing a conductive substance in an epoxy resin adhesive.

16. The ink-jet head according to claim 11, wherein the one outer wall surface of the main head body is a cover plate or a piezoelectric ceramic plate for constructing the main head body.

17. The ink-jet head according to claim 11, wherein the ink chambers are comparted by walls composed of the piezoelectric elements, and the walls composed of the piezoelectric elements are perpendicular to the one outer wall surface of the main head body.

18. The ink-jet head according to claim 11, further comprising an ink cartridge.

19. The ink-jet head of claim 11, wherein the anisotropic conductive material is thermally conductive to radiate heat away from the IC chip to the main head body.

20. The ink-jet head of claim 11, wherein the IC chip includes electrodes and the IC chip is thermally connected to the main head body by the anisotropic conductive material at surface portions of the IC chip at locations in addition to the electrodes.

21. An ink-jet recording apparatus comprising:

an ink-jet head including:

a main head body including ink chambers formed therein;

piezoelectric elements for changing a volume of each of the ink chambers in accordance with application of a driving voltage; and an IC chip including a driving circuit for driving the piezoelectric elements, the IC chip being attached to an outer wall surface of the main body head by way of a resin material intervened therebetween such that at least one of the ink chambers is disposed under the IC chip; and a carriage for carrying the ink-jet head and an ink cartridge, the carriage being relatively movable with respect to an objective print medium, wherein the resin material is thermally conductive to radiate heat away from the IC chip to the ink-jet head.

22. The ink-jet recording apparatus according to claim 21, wherein the IC chip is attached to a cover plate or a piezoelectric ceramic plate for constructing the main head body, via the resin material intervened therebetween.

23. The ink-jet recording apparatus according to claim 21, wherein the resin is an epoxy resin.

24. The ink-jet recording apparatus according to claim 21, wherein:

head electrodes connected to the piezoelectric elements are formed on one outer wall surface of the main head body, and chip electrodes electrically connected to the driving circuit are formed on one surface of the IC chip; and the IC chip is attached to the outer wall surface of the main head body so that the one outer wall surface of the main head body is opposed to the one surface of the IC chip, and the head electrodes are electrically connected to the chip electrodes, and the resin is charged between the one outer wall surface of the main head body and the one surface of the IC chip.

25. The ink-jet recording apparatus according to claim 24, wherein the head electrodes and the chip electrodes are electrically connected to one another by the aid of a conductive adhesive, whereby the IC chip is attached to the outer wall surface of the main head body.

26. The ink-jet recording apparatus according to claim 24, wherein the head electrodes and the chip electrodes are electrically connected to one another by the aid of solder.

27. The ink-jet recording apparatus according to claim 24, wherein the ink chambers are comparted by walls composed of the piezoelectric elements, and the walls composed of the piezoelectric elements are perpendicular to the one outer wall surface of the main head body.

28. The ink-jet recording apparatus according to claim 21, wherein the IC chip is attached to the outer wall surface of the main head body via the resin material intervened therebetween, and the IC chip is covered with the resin material.

29. An ink-jet recording apparatus comprising:

an ink-jet head including:

a main head body including ink chambers formed therein;

piezoelectric elements for changing a volume of each of the ink chambers in accordance with application of a driving voltage; and an IC chip including a driving circuit for driving the piezoelectric elements, the IC chip being attached to an outer wall surface of the main head body by way of an anisotropic conductive material intervened therebetween wherein at least one of the ink chambers is disposed under the IC chip and whereby the driving circuit is electrically connected to the piezoelectric elements; and a carriage for carrying the ink-jet head and an ink cartridge, the cartridge being relatively movable with respect to an objective print medium.

30. The ink-jet recording apparatus according to claim 29, wherein the driving circuit is electrically connected to the piezoelectric elements by pressing the anisotropic conductive material in a direction to allow the driving circuit to approach the piezoelectric elements.

31. The ink-jet recording apparatus according to claim 30, wherein:

head electrodes connected to the piezoelectric elements are formed on one outer wall surface of the main head body, and chip electrodes electrically connected to the driving circuit are formed on one surface of the IC chip; and the one outer wall surface of the main head body is opposed to the one surface of the IC chip, and the anisotropic conductive material is charged between the one outer wall surface of the main head body and the one surface of the IC chip so that the driving circuit is electrically connected to the piezoelectric elements.

32. The ink-jet recording apparatus according to claim 30, wherein the anisotropic conductive material has an adhesive property, and the one outer wall surface of the main head body is glued to the one surface of the IC chip by the aid of the anisotropic conductive material.

33. The ink-jet recording apparatus according to claim 32, wherein the anisotropic conductive material is a material obtained by dispersing a conductive substance in an epoxy resin adhesive.

34. The ink-jet recording apparatus according to claim 29, wherein the one outer wall surface of the main head body is a cover plate or a piezoelectric ceramic plate for constructing the main head body.

35. The ink-jet recording apparatus according to claim 29, wherein the ink chambers are comparted by walls composed of the piezoelectric elements, and the walls composed of the piezoelectric elements are perpendicular to the one outer wall surface of the main head body.

36. A method for installing an IC chip including a circuit for driving piezoelectric elements to an ink-jet head for discharging an ink by driving the piezoelectric elements, comprising the steps of:

placing an anisotropic conductive material having an adhesive property on one of an outer wall surface of the ink-jet head including head electrodes formed thereon and a surface of the IC chip including chip electrodes formed thereon;

positioning the IC chip adjacent the outer wall surface of the ink-jet head such that at least one ink chamber formed in the ink-jet head is disposed under the IC chip;

covering the anisotropic conductive material with the other of the outer wall surface of the ink-jet head including the head electrodes formed thereon and the surface of the IC chip including the chip electrodes formed thereon; and pressing the anisotropic conductive material interposed between the ink-jet head and the IC chip, from at least one of the ink-jet head and the IC chip.

37. The method according to claim 36, wherein the anisotropic conductive material having the adhesive property is a material obtained by dispersing a conductive substance in an epoxy resin adhesive.

38. The method of claim 36, in which the anisotropic conductive material is also thermally conductive to radiate heat away from the IC chip to the ink-jet head.

39. The method according to claim 36, further comprising covering a surface of the IC chip with a thermally conductive resin so that the resin is interposed between the IC chip and the outer wall surface of the ink-jet head to radiate heat away from the IC chip towards the ink-jet head.

40. The method according to claim 39, further comprising the step of covering an upper surface of the IC chip with the resin.

* * * * *